US006875735B1

(12) United States Patent
Frankenbach et al.

(10) Patent No.: US 6,875,735 B1
(45) Date of Patent: Apr. 5, 2005

(54) CLEAR OR TRANSLUCENT AQUEOUS FABRIC SOFTENER COMPOSITIONS CONTAINING HIGH ELECTROLYTE CONTENT AND OPTIONAL PHASE STABILIZER

(75) Inventors: Gayle Marie Frankenbach, Cincinnati, OH (US); Ellen Schmidt Baker, Cincinnati, OH (US); Rebecca Gayl Baker, Hamilton, OH (US); Marc Johan Declercq, Bever (BE); Hugo Jean Marie Demeyere, Merchtem (BE); Ryan Matthew Heiden, Amelia, OH (US); Charles Albert Hensley, Cincinnati, OH (US); Brent Alan Kolb, Cincinnati, OH (US); Ruth Anne Murphy, Cincinnati, OH (US); Ronald Edward Pegoli, Batavia, OH (US); Toan Trinh, Maineville, OH (US); Errol Hoffman Wahl, Cincinnati, OH (US); Michael R. Weaver, Cincinnati, OH (US); Dean Larry DuVal, Kobe (JP); John Henry Shaw, Jr., Cincinnati, OH (US); Masae Nogami, Suita (JP); Ronghui Wu, Gurnee, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,969

(22) PCT Filed: Nov. 24, 1998

(86) PCT No.: PCT/US98/25079

§ 371 (c)(1),
(2), (4) Date: May 23, 2000

(87) PCT Pub. No.: WO99/27050

PCT Pub. Date: Jun. 3, 1999

Related U.S. Application Data

(60) Provisional application No. 60/076,564, filed on Mar. 2, 1998, provisional application No. 60/098,450, filed on Aug. 31, 1998, provisional application No. 60/098,455, filed on Aug. 31, 1998, provisional application No. 60/098,514, filed on Aug. 31, 1998, provisional application No. 60/098,545, filed on Aug. 31, 1998, and provisional application No. 60/066,424, filed on Nov. 24, 1997.

(51) Int. Cl.[7] ..... C11D 3/04

(52) U.S. Cl. ..... 510/527; 510/522

(58) Field of Search ..... 510/527, 522

(56) References Cited

U.S. PATENT DOCUMENTS

| | | | | |
|---|---|---|---|---|
| 5,525,245 A | 6/1996 | Grandmaire et al. | ..... | 252/8.8 |
| 5,747,108 A | 5/1998 | Farooq et al. | ..... | 427/242 |

FOREIGN PATENT DOCUMENTS

| | | | |
|---|---|---|---|
| JP | 63-223098 | | 9/1988 |
| WO | WO 94/20597 | | 9/1994 |
| WO | WO 97/03169 | * | 1/1997 |
| WO | WO 98/08924 | | 3/1998 |

* cited by examiner

*Primary Examiner*—John R. Hardee
(74) *Attorney, Agent, or Firm*—Jason J. Camp; Mark A. Charles; David V. Upite

(57) ABSTRACT

Clear, or translucent fabric softener compositions comprise fabric softener compound, principal solvent system, and high electrolyte levels. The high electrolyte level allows for a broader range of principal solvents to be used and/or reduces the incidence of increased viscosity when low levels of principal solvent are used. Phase stabilizers which are primarily ethoxylated hydrophobic materials can be used to reduce the amount of principal solvent that is needed and/or to stabilize the compositions in the presence of the highest levels of electrolyte. Specific phase stabilizers provide additional benefits including improved softening. Specific electrolytes provide improved results. Addition of primary solvents and/or phase stabilizers to the softener compounds can improve the viscosity/handling of the compounds and the ability to create the finished compositions.

32 Claims, No Drawings

CLEAR OR TRANSLUCENT AQUEOUS FABRIC SOFTENER COMPOSITIONS CONTAINING HIGH ELECTROLYTE CONTENT AND OPTIONAL PHASE STABILIZER

This application is a 371 of PCT/US98/25079 filed Nov. 24, 1998, which claims benefit of provisional application 60/066,424 filed Nov. 24, 1997 which claims benefit to provisional application 60/098,450 filed Aug. 31, 1998 which claims benefit to provisional application 60/098,455 filed Aug. 31, 1998 which claims benefit to provisional application 60/098,514 filed Aug. 31, 1998 which claims benefit to provisional application 60/098,545 filed Aug. 31, 1998 which claims the benefit to provisional application 60/076,564 filed Mar. 2, 1998.

TECHNICAL FIELD

The present invention relates to specific clear or translucent fabric softener compositions. Specifically, clear, or translucent liquid compositions are prepared with (high electrolyte levels to provide a dilution viscosity benefit and/or to allow the use of less and/or additional principal solvents as described hereinafter. Optionally, but preferably, the compositions can also contain an optional phase stabilizer, e.g., nonionic, ethoxylated cationic, etc. surfactant to improve properties.

BACKGROUND OF THE INVENTION

Concentrated clear compositions containing ester and/or amide linked fabric softening actives and specific principal solvents are disclosed in U.S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition With Good Freeze/Thaw Recovery and Highly Unsaturated Fabric Softener Compound Therefor, and in U.S. Pat. No. 5,747,443, issued May 5, 1998 in the names of Wahl, Trinh, Gosselink, Letton, and Sivik for Fabric Softening Compound/Composition, said patents being incorporated herein by reference. The fabric softener actives in said patents are preferably biodegradable ester-linked materials, containing, long hydrophobic groups with unsaturated chains. Similar clear liquid fabric softening compositions are described in WO 97/03169, incorporated herein by reference, which describes the formulation of liquid fabric softening compositions using said specific principal solvents.

Lowering the principal solvent/softener ratio below a critical point can result in an increase in viscosity and/or gelling of the fabric softener composition on dilution into water which adversely affects performance through an increase in fabric staining incidents, more residue left in machine-attached and machine-independent dispensers, less deposition of fabric softener active, and less uniform deposition of fabric softener active. This critical ratio differs for the different solvents, but in general it is believed that the solvent/softener ratio at which gelling occurs is higher for relatively water immiscible solvents vs. water miscible solvents. The gelling and/or increased viscosity upon dilution is particularly unacceptable when it occurs between the dilution ratios of from about 1:1 to about 1:5 (fabric softener composition to water) since many consumers practice the habit of pre-diluting fabric softener compositions to these ratios. This habit is typical and is recommended by many washing machine manufacturers for consumers using the automatic dispensing device supplied with their washing machine. Increased viscosity or gelling of the fabric softener upon dilution, whether the dilution is a pre-dilution carried out by the consumer or the machine or whether dilution is carried out during the rinse cycle through dispensing into the rinse by the consumer, by an appliance, or by the machine, can adversely affect the dispersion of the fabric softener composition in the rinse, resulting in poor performance, including an increase in fabric staining incidents.

SUMMARY OF THE INVENTION

The clear, or translucent liquid fabric softener compositions herein comprise:

A. from about 2% to about 80%, preferably from about 13% to about 75%, more preferably from about 17% to about 70%, and even more preferably from about 19% to about 65%, by weight of the composition, of fabric softener active, more preferably biodegradable fabric softener actives as disclosed hereinafter. The phase transition temperature of the softener active or mixture of actives, containing less than 5% organic solvent or water, is preferably less than 50° C., more preferably less than about 35° C., even more preferably less than about 20° C., and yet even more preferably less than about 10° C., or is amorphous and has no significant endothermic phase transition in the region −50° C. to 100° C., as measured by differential scanning calorimetry as disclosed hereinafter.

B. at least an effective level of principal solvent preferably having a ClogP of from about −2.0 to about 2.6, more preferably from about −1.7 to about 1.6, and even more preferably from about −1.0 to about 1.0, as defined hereinafter, typically at a level that is less than about 40%, preferably from about 1% to about 25%, more preferably from about 3% to about 10% by weight of the composition;

C. from about 0.5% to about 10% by weight, preferably from about 0.75% to about 2.5% by weight of the composition, and more preferably from about 1% to about 2% by weight of the composition of electrolyte as defined hereinafter;

D. optionally, but preferably, from 0% to about 15%, preferably from about 0.1% to about 7%, and more preferably from about 1% to about 6%, by weight of the composition of phase stabilizer, preferably surfactant containing alkoxylation, and also preferably having an HLB of from about 8 to about 20, more preferably from about 10 to about 18, and even more preferably from about 11 to about 15, and more preferably as described hereinafter; and the balance water.

E. The clear, or translucent liquid fabric softener compositions can optionally also contain:
   (a) optionally, but preferably, from 0% to about 15%, more preferably from about 0.1% to about 8%, and even more preferably from about 0.2% to about 5%, of perfume;
   (b) principal solvent extenders;
   (c) cationic charge boosters;
   (d) other optional ingredients such as brighteners, chemical stabilizers, enzymes, soil release agents, bactericides, chelating agents, silicones, color care agents; and
   (e) mixtures thereof.

Preferably, the compositions herein are aqueous, translucent or clear, preferably clear, compositions containing from about 10% to about 95%, preferably from about 20% to about 80%, more preferably from about 30% to about 70%, and even more preferably from about 40% to about 60%, water. These products (compositions) are usually not translucent or clear without principal solvent B.

The principal solvent and/or electrolyte levels, as well as the identity of the principal solvent, are related to the level and identity of the softener. The higher the softener level, surprisingly, the greater the choice of level and identity of principal solvent, electrolyte, and phase stabilizer which will yield clear stable compositions. The electrolyte and phase stabilizer are typically used at the lowest level that will provide the desired result.

The pH of the compositions, especially those containing the preferred softener actives comprising an ester linkage, should be from about 1 to about 5, preferably from about 2 to about 4, and more preferably from about 2.7 to about 3.5.

DETAILED DESCRIPTION OF THE INVENTION

A. Fabric Softener Actives

Typical levels of incorporation of the softening compound (active) in the softening composition are of from 2% to 80% by weight, preferably from 5% to 75%, more preferably from 15% to 70%, and even more preferably from 19% to 65%, by weight of the composition, and preferably is biodegradable as disclosed hereinafter.

As has been previously disclosed in U.S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition with Good Freeze/Thaw Recovery and Highly Unsaturated Fabric Softener Compound Therefor, and in U.S. Pat. No. 5,747,443, issued May 5, 1998 in the names of Wahl, Trinh, Gosselink, Letton, and Sivik for Fabric Softening Compound/Composition, it has been found that softener actives with alkyl chains that are unsaturated or branched are particularly well suited for use in clear or translucent aqueous fabric softener compositions. An indicator of the suitability of softener actives for use in the compositions of this invention is the phase transition temperature. Preferably, the phase transition temperature of the softener active or mixture of actives, containing less than 5% organic solvent or water, is less than 50° C., more preferably less than about 35° C., even more preferably less than about 20° C., and yet even more preferably less than about 10° C., or is amorphous and has no significant endothermic phase transition in the region −50° C. to 100° C.

The phase transition temperature can be measured with a Mettler TA 3000 differential scanning calorimeter with Mettler TC 10A Processor.

The softening compound can be selected from cationic, nonionic, and/or amphoteric fabric softening compounds. Typical of the cationic softening compounds are the quaternary ammonium compounds or amine precursors thereof as defined hereinafter.

Preferred Diester Quaternary Ammonium Fabric Softening Active Compound (DEQA)

(1) The first type of DEQA preferably comprises, as the principal active, [DEQA(1)] compounds of the formula $$\{R_{4-m}—N^+[—(CH_2)—Y—R^1]_m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, Poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate (As used herein, the "percent of softener active" contain ing a given $R^1$ group is based upon taking a percentage of the total active based upon the percentage that the given $R^1$ group is, of the total $R^1$ groups present.);

(2) A second type of DEQA active [DEQA (2)] has the general formula:

$$[R_3N^+CH_2CH(YR^1)(CH_2YR^1)]\ X^-$$

wherein each Y, R, $R^1$, and $X^-$have the same meanings as before. Such compounds include those having the formula:

$$[CH_3]_3\ N^{(+)}[CH_2CH(CH_2O(O)CR^1)O(O)CR^1]Cl^{(-)}$$

wherein each R is a methyl or ethyl group and preferably each $R^1$ is in the range Of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium fabric softener active having the formula 1,2-di(acyloxy)-3-trimethylammoniopropane chloride, where the acyl is the same as that of $FA^1$ disclosed hereinafter.

Some preferred clear fabric softening compositions of the present invention contain as an essential component from about 2% to about 75%, preferably from about 8% to about 70%, more preferably from about 13% to about 65%, and even more preferably from about 18% to about 45% by weight of the composition, of softener active having the formula:

$$[R^1C(O)OC_2H_4]_mN^+(R)_{4-m}X^-$$

wherein each $R^1$ in a compound is a $C_6$–$C_{22}$ hydrocarbyl group, preferably having an IV from about 70 to about 140 based upon the IV of the equivalent fatty acid with the cis/trans ratio preferably being as described hereinafter, m is a number from 1 to 3 on the weight average in any mixture of compounds, each R in a compound is a $C_{1-3}$ alkyl or hydroxy alkyl group, the total of m and the number of R groups that are hydroxyethyl groups equaling 3, and X is a softener compatible anion, preferably methyl sulfate. Preferably the cis trans isomer ratio of the fatty acid (of the C18:1 component) is at least about 1:1, preferably about 2:1, more preferably about 3:1, and even more preferably about 4:1, or higher.

These preferred compounds, or mixtures of compounds, have (a) either a Hunter "L" transmission of at least about 85, typically from about 85 to about 95, preferably from about 90 to about 95, more preferably above about 95, if possible, (b) only low, relatively non-detectable levels, at the conditions of use, of odorous compounds selected from the group consisting of: isopropyl acetate; 2,2'-ethylidenebis (oxy)bis-propane; 1,3,5-trioxane; and/or short chain fatty acid (4–12, especially 6–10, carbon atoms) esters, especially methyl esters; or (c) preferably, both.

The Hunter L transmission is measured by (I) mixing the softener active with solvent at a level of about 10% of active, to assure clarity, the preferred solvent being ethoxylated (one mole EO) 2,2,4-trimethyl-1,3-pentanediol and (2) measuring the L color value against distilled water with a Hunter Color QUEST® calorimeter made by Hunter Associates Laboratory, Reston, Va.

The level of odorant is defined by measuring the level of odorant in a headspace over a sample of the softener active (about 92% active). Chromatograms are generated using about 200 mL of head space sample over about 2.0 grams of sample. The head space sample is trapped on to a solid absorbent and thermally desorbed onto a column directly via cryofocussing at about −100° C. The identifications of materials is based on the peaks in the chromatograms. Some impurities identified are related to the solvent used in the quaternization process, (e.g., ethanol and isopropanol). The ethoxy and methoxy ethers are typically sweet in odor. There are $C_6$–$C_8$ methyl esters found in a typical current commercial sample, but not in the typical softener actives of this invention. These esters contribute to the perceived poorer odor of the current commercial samples. The level of each odorant in ng/L found in the head space over a preferred active is as follows: Isopropyl acetate—<1; 1,3,5-trioxane—5; 2,2'—ethylidenebis(oxy)-bispropane—<1; $C_6$ methyl ester—<1; C, Methyl ester—<1; and $C_{10}$ Methyl ester—<1. odorant The acceptable level of each odorant is as follows: isopropyl acetate should be less than about 5, preferably less than about 3, and more preferably less than about 2, nanograms per liter (θg/L.); 2,2'-ethylidenebis(oxy)bis-propane should be less than about 200, preferably less than about 100, more preferably less than about 10, and even more preferably less than about 5, nanograms per liter (θg/L.); 1,3,5-trioxane should be less than about 50, preferably less than about 20, more preferably less than about 10, and even more preferably less than about 7, nanograms per liter (θg/L.); and/or each short chain fatty acid (4–12, especially 6–10, carbon atoms) ester, especially methyl esters should be less than about 4, preferably less than about 3, and more preferably less than about 2, nanograms per liter (θg/L.).

The elimination of color and odor materials can either be accomplished after formation of the compound, or, preferably, by selection of the reactants and the reaction conditions. Preferably, the reactants are selected to have good odor and color. For example, it is possible to obtain fatty acids, or their esters, for sources of the long fatty acyl group, that have good color and odor and which have extremely low levels of short chain ($C_{4-12}$, especially $C_{6-10}$) fatty acyl groups. Also, the reactants can be cleaned up prior to use. For example, the fatty acid reactant can be double or triple distilled to remove color and odor causing bodies and remove short chain fatty acids. Additionally, the color of a triethanolamine reactant if used needs to be controlled to a low color level (e.g. a color reading of about 20 or less on the APHA scale). The degree of clean up required is dependent on the level of use and the presence of other ingredients. For example, adding a dye can cover up some colors. However, for clear and/or light colored products, the color must be almost non-detectable. This is especially true for higher levels of active, e.g., from about 2% to about 80%, preferably from about 13% to about 75%, more preferably from about 17% to about 70%, and even more preferably from about 19% to about 65% of the softener active by weight of the composition. Similarly, the odor can be covered up by higher levels of perfume, but at the higher levels of softener active there is a relatively high cost associated with such an approach, especially in terms of having to compromise the odor quality. Odor quality can be further improved by use of ethanol as the quaternization reaction solvent.

A preferred biodegradable fabric softener compounds comprises quaternary ammonium salt, the quaternized ammonium salt being a quaternized product of condensation between:

a)—a fraction of saturated or unsaturated, linear or branched fatty acids, or of derivatives of said acids, said fatty acids or derivatives each possessing a hydrocarbon chain in which the number of atoms is between 5 and 21, and b)—triethanolamine, characterized in that said condensation product has an acid value, measured by titration of the condensation product with a standard KOH solution against a phenolphthalein indicator, of less than about 6.5.

The acid value is preferably less than or equal to about 5, more preferably less than about 3. Indeed, the lower the AV, the better softness performance is obtained.

The acid value is determined by titration of the condensation product with a standard KOH solution against a phenolphthalein indicator according to ISO#53402. The AV is expressed as mg KOH/g of the condensation product.

For optimum softness benefit, it is preferred that the reactants are present in a molar ratio of fatty acid fraction to triethanolamine of from about 1:1 to about 2.5:1.

It has also been found that the optimum softness performance is also affected by the detergent carry-over laundry conditions, and more especially by the presence of the anionic surfactant in the solution in which the softening composition is used. Indeed, the presence of anionic surfactant that is usually carried over from the wash will interact with the softener compound, thereby reducing its performance. Thus, depending on usage conditions, the mole ratio of fatty acid/triethanolamine can be critical. Accordingly, where no rinse occurs between the wash cycle and the rinse cycle containing the softening compound, a high amount of anionic surfactant will be carried over in the rinse cycle containing the softening compound. In this instance, it has been found that a fatty acid fraction/triethanolamine mole ratio of about 1.4:1 to about 1.8:1 is preferred. By high amount of anionic surfactant, it is meant that the presence of anionic in the rinse cycle at a level such that the molar ratio anionic surfactant/cationic softener compound of the invention is at least about 1/10.

These fabric softener compounds for use herein are typically mixtures of materials. The weight percentages of compounds wherein one (monoester), two (diester), or three (triester) of the triethanolamine hydroxy groups is esterified with a fatty acyl group are as follows: Monoester—from about 12% to about 22%; diester—from about 43% to about 57%; and triester—from about 13% to about 28%. These compounds, as formed and used in the formulation of fabric softener compositions, typically contain from about 6% to about 20% by weight of solvent, e.g., from about 3% to about 10% of a lower molecular alcohol like ethanol and from about 3% to about 10% of solvent that is more hydrophobic, like hexylene glycol.

A method of treating fabrics comprises the step of contacting the fabrics in an aqueous medium containing the above softener compounds or softening composition wherein the fatty acid/triethanolamine mole ratio in the softener compound is from about 1.4:1 to about 1.8:1, preferably about 1.5:1 and the aqueous medium comprises a molar ratio of anionic surfactant to said softener compound of the invention of at least about 1:10.

When an intermediate rinse cycle occurs between the wash and the later rinse cycle, less anionic surfactant, i.e.

less than about 1:10 of a molar ratio anionic surfactant to cationic compound of the invention, will then be carried over. Accordingly, it has been found that a fatty acid/triethanolamine mole ratio of about 1.8:1 to about 2.2:1 is then preferred. I.e., then the method of treating fabrics comprises the step of contacting the fabrics in an aqueous medium containing the softener compound of the invention or softening composition thereof wherein the fatty acid/triethanolamine mole ratio in the softener compound is from about 1.8:1 to about 2:1, preferably about 2.0:1, and most preferably about 1.9, and the aqueous medium comprises a molar ratio of anionic surfactant to said softener compound of the invention of less than about 1:10.

In a preferred embodiment the fatty acid fraction and the triethanolamine are present in a molar ratio of from about 1:1 to about 2.5:1.

Preferred cationic, preferably biodegradable quaternary, ammonium fabric softening compounds can contain the group —(O)CR$^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | FA$^1$ | FA$^2$ | FA$^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 9 | 27 | 45 |
| C18:2 | 13 | 50 | 6 |
| C18:3 | 1 | 7 | 0 |
| Unknowns | 0 | 0 | 3 |
| Total | 100 | 100 | 100 |
| IV | 99 | 125–138 | 56 |
| cis/trans (C18:1) | 5–6 | Not Available | 7 |
| TPU | 14 | 57 | 6 |

FA$^1$ is a partially hydrogenated fatty acid prepared from canola oil, FA$^2$ is a fatty acid prepared from soy bean oil, and FA$^3$ is a slightly hydrogenated tallow fatty acid.

Preferred softener actives contain an effective amount of molecules containing two ester linked hydrophobic groups [R$^1$C(CO)O—], said actives being referred to hereinafter as "DEQA's", are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 99%, more preferably from about 60% to about 98%, and that the total level of active containing polyunsaturated fatty acyl groups (TPU) be preferably from 0% to about 30%. The cis/trans ratio for the unsaturated fatty acyl groups is usually important, with the cis/trans ratio being from about 1:1 to about 50:1, the minimum being about 1:1, preferably at least about 3:1, and more preferably from about 4:1 to about 20:1. (As used herein, the "percent of softener active" containing a given R$^1$ group is the same as the percentage of that same R$^1$ group is to the total R$^1$ groups used to form all of the softener actives.) The unsaturated, including the preferred polyunsaturated, fatty acyl and/or alkylene groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain a low viscosity for the neat product composition and are therefore easier to process, e.g., pump, mixing, etc. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it minimizes degradation. Additional protection against degradation can be provided when the compounds and softener compositions contain effective antioxidants, chelants, and/or reducing agents, as disclosed hereinafter.

It will be understood that substituents R and R$^1$ can optionally be substituted with various groups such as alkoxyl or hydroxyl groups, and can be straight, or branched so long as the R$^1$ groups maintain their basically hydrophobic character.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups.

As used herein, when the DEQA diester (m=2) is specified, it can include the monoester (m=1) and/or triester (m=3) that are present. Preferably, at least about 30% of the DEQA is in the diester form, and from 0% to about 30% can be DEQA monoester, e.g., there are three R groups and one R$^1$ group. For softening, under no/low detergent carry-over laundry conditions the percentage of monoester should be as low as possible, preferably no more than about 15%. However, under high, anionic detergent surfactant or detergent builder carry-over conditions, some monoester can be preferred. The overall ratios of diester "quaternary ammonium active" (quat) to monoester quat are from about 2.5:1 to about 1:1, preferably from about 2.3:1 to about 1.3:1. Under high detergent carry-over conditions, the di/monoester ratio is preferably about 1.3:1. The level of monoester present can be controlled in manufacturing the DEQA by varying the ratio of fatty acid, or fatty acyl source, to triethanolamine. The overall ratios of diester quat to triester quat are from about 10:1 to about 1.5:1, preferably from about 5:1 to about 2.8:1.

The above compounds can be prepared using standard reaction chemistry. In one synthesis of a di-ester variation of DTDMAC, triethanolamine of the formula $N(CH_2CH_2OH)_3$ is esterified, preferably at two hydroxyl groups, with an acid chloride of the formula $R^1C(O)CI$, to form an amine which can be made cationic by acidification (one R is H) to be one type of softener, or then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

In preferred DEQA (1) and DEQA (2) softener actives, each $R^1$ is a hydrocarbyl, or substituted hydrocarbyl, group, preferably, alkyl, monounsaturated alkenyl, and polyunsaturated alkenyl groups, with the softener active containing polyunsaturated alkenyl groups being preferably at least about 3%, more preferably at least about 5%, more preferably at least about 10%, and even more preferably at least about 15%, by weight of the total softener active present; the actives preferably containing mixtures of $R^1$ groups, especially within the individual molecules.

The DEQAs herein can also contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 15%, more preferably below about 10%, and even more preferably below about 5%, by weight of the softener active.

The fabric softener actives herein are preferably prepared by a process wherein a chelant, preferably a diethylenetriaminepentaacetate (DTPA) and/or an ethylene diamine-N, N'-disuccinate (EDDS) is added to the process. Another acceptable chelant is tetrakis-(2-hydroxylpropyl) ethylenediamine (TPED). Also, preferably, antioxidants are added to the fatty acid immediately after distillation and/or fractionation and/or during the esterification reactions and/or post-added to the finished softener active. The resulting softener active has reduced discoloration and malodor associated therewith.

The total amount of added chelating agent is preferably within the range of from about 10 ppm to about 5,000 ppm, more preferably within the range of from about 100 ppm to about 2500 ppm by weight of the formed softener active. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of the steps in the processing of the triglyceride up to, and including, the formation of the fabric softener active.

The above processes produce a fabric softener active with reduced coloration and malodor.

Preparation of a fabric softening premix composition comprises preparing a fabric softening active as described above and mixing the fabric softener active, optionally containing a low molecular weight solvent, with a principal solvent having a ClogP, as described hereinafter, of from about −2.0 to about 2.6 thereby forming a fabric softener premix. The premix can comprise from about 55% to about 85% by weight of fabric softening active and from about 10% to about 30% by weight of principal solvent. Again, the process can also include the step of adding from about 0.01% to about 2% by weight of the composition of an antioxidant compound to any or all of the processing steps.

Other Softener Actives

The compositions can also contain other, usually supplementary, fabric softener active(s), usually in minor amounts, typically from 0% to about 35%, preferably from about 1% to about 20%, more preferably from about 2% to about 10%, said other fabric softener active being selected from:

(1) softener having the formula:

$$[R_{4-m}—N^{(+)}—R^1{}_m]A^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{2-0}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_{1-3}$ alkyl or hydroxyalkyl group, e.g., methyl (most preferred), ethyl, propyl, hydroxyethyl, and the like, benzyl, or $(R^2O)_{24}H$ where each $R^2$ is a $C_{1-6}$ alkylene group; and $A^-$ is a softener compatible anion, preferably, chloride, bromide, methylsulfate, ethylsulfate, sulfate, and nitrate, more preferably chloride and methyl sulfate;

(2) softener having the formula:

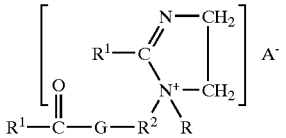

wherein each R, $R^1$, and $A^-$ have the definitions given above; each $R^2$ is a $C_{1-6}$ alkylene group, preferably an ethylene group; and G is an oxygen atom or an —NR— group;

(3) softener having the formula:

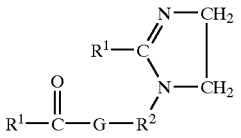

wherein $R^1$, $R^2$ and G are defined as above;

(4) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group;

(5) softener having the formula:

$$[R^1—C(O)—NR—R^2—N(R)_2—R^3—NR—C(O)—R^1]A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

(7) softener having the formula:

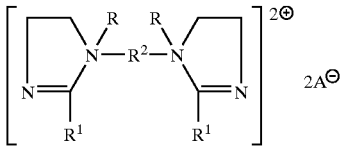

wherein R, $R^1$, $R^2$, and $A^-$ are defined as above; and (8) mixtures thereof.

Other optional but highly desirable cationic compounds which can be used in combination with the above softener actives are compounds containing one long chain acyclic $C_8$–$C_{22}$ hydrocarbon group, selected from the group consisting of:

(8) acyclic quaternary ammonium salts having the formula:

$$[R^1—N(R^5)_2—R^6]_+ A^-$$

wherein $R^5$ and $R^6$ are $C_1$–$C_4$ alkyl or hydroxyalkyl groups, and $R^1$ and $A^-$ are defined as herein above;

(9) substituted imidazolinium salts having the formula:

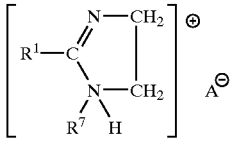

wherein $R^7$ is hydrogen or a $C_1$–$C_4$ saturated alkyl or hydroxyalkyl group, and $R^1$ and $A^-$ are defined as hereinabove;

(10) substituted imidazolinium salts having the formula:

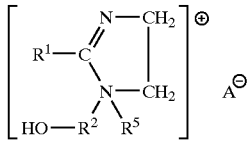

wherein $R^5$ is a $C_1$–$C_4$ alkyl or hydroxyalkyl group, and $R^1$, $R^2$, and $A^-$ are as defined above;

(11) alkylpyridinium salts having the formula:

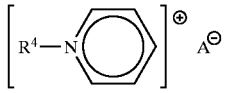

wherein $R^4$ is an acyclic aliphatic $C_9$–$C_{22}$ hydrocarbon group and $A^-$ is an anion; and

(12) alkanamide alkylene pyridinium salts having the formula:

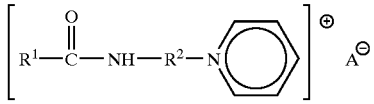

wherein $R^1$, $R^2$ and $A^-$ are defined as herein above; and mixtures thereof.

Examples of Compound (8) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (8) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl) oleylammonium chloride wherein $R^1$ is a $C_{1-8}$ hydrocarbon group, $R^5$ is a 2-hydroxyethyl group and $R^6$ is a methyl group.

Additional fabric softeners that can be used herein are disclosed, at least generically for the basic structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference. The additional softener actives herein are preferably those that are highly unsaturated versions of the traditional softener actives, i.e., di-long chain alkyl nitrogen derivatives, normally cationic materials, such as dioleyldimethylammonium chloride and imidazolinium compounds as described hereinafter. Examples of more biodegradable fabric softeners can be found in U.S. Pat. No. 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979;U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and U.S. Pat. No. 4,339,391, Hoffman et al., issued Jul. 13, 1982, said patents being incorporated herein by reference.

Examples of Compound (1) are dialkylenedimethylammonium salts such as dicanoladimethylammonium chloride, dicanoladimethylammonium methylsulfate, di(partially hydrogenated soybean, cis/trans ratio of about 4:1) dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (2) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (3) is 1-oleylamidoethyl-2-oleylimidazoline wherein $R^1$ is an acyclic aliphatic $C_{15}$–$C_7$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyldiethylenetriamine with the formula:

$$R^1—C(O)NH—CH_2CH_2—NH—CH_2CH_2—NH—C(O)R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a difatty amidoamine based softener having the formula:

$$[R^1—C(O)—NH—CH_2CH_2—N(CH_3)(CH_2CH_2OH)CH_2CH_2—NH—C(O)—R^1]^+CH_3SO_4^-$$

wherein $R^1$—C(O) is oleoyl group, available commercially from the Witco Corporation under the trade name Varisoft® 222LT.

An example of Compound (6) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

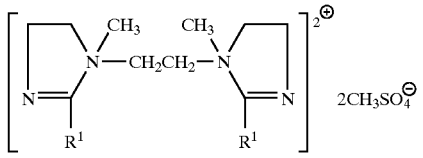

wherein $R^1$ is derived from oleic acid, and the compound is available from Witco Company.

An example of Compound (11) is 1-ethyl-1-(2-hydroxyethyl)$_2$-isoheptadecylimidazolinium ethylsulfate wherein $R^1$ is a $C_{1-7}$ hydrocarbon group, $R^2$ is an ethylene group, $R^5$ is an ethyl group, and $A^-$ is an ethylsulfate anion.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

B. Principal Solvent System

The principal solvent is typically used at an effective level up to about 40% by weight, preferably from about 1% to about 25%, more preferably from about 3% to about 8%, by weight of the composition. An advantage of the high electrolyte level and/or the phase stabilizers disclosed herein is that lower levels of principal solvents and/or a wider range of principal solvents can be used to provide clarity. E.g., without the high level of electrolyte, the ClogP of the principal solvent system as disclosed hereinafter would typically be limited to a range of from about 0.15 to about 0.64 as disclosed in said '443 patent. It is known that higher ClogP compounds, up to about 1 can be used when combined with other solvents as disclosed in now abandoned provisional application Ser. No. 60/047,058, filed May 19, 1997 in the names of H. B. Tordil, E. H. Wahl, T. Trinh, M. Okamoto, and D. L. DuVal (now PCT/US98/10167 filed May 18, 1998), or with nonionic surfactants, and especially with the phase stabilizers disclosed herein as previously disclosed in Provisional Application Ser. No. 60/076,564, the inventors being D. L. DuVal, G. M. Frankenbach, E. H. Wahl, T. Trinh, H. J. M. Demeyere, A. H. Shaw and M. Nogami. Title: Concentrated, Stable, Translucent or Clear Fabric Softening Compositions, both of said applications being incorporated herein by reference. With the electrolyte present, the level of principal solvent can be less and/or the ClogP range that is usable is broadened to include from about −2.0 to about 2.6, more preferably from about −1.7 to about 1.6, and even more preferably from about −1.0 to about 1.0.

With the electrolyte present, levels of principal solvent that are substantially less than about 15% by weight of the composition can be used, which is preferred for odor, safety and economy reasons. The phase stabilizer as defined hereinafter, in combination with a very low level of principal solvent is sufficient to provide good clarity and/or stability of the composition when the electrolyte is present. In preferred compositions, the level of principal solvent is insufficient to provide the required degree of clarity and/or stability and the addition of the electrolyte and/or the phase stabilizer provides the desired clarity/stability. Said electrolyte and/or said phase stabilizer can be used to either make a composition translucent or clear, or can be used to increase the temperature range at which the composition is translucent or clear.

Thus one can use the principal solvent, at the previously indicated levels, in a method in which the said principal solvent is added to a composition that is not translucent, or clear, or which has a temperature where phase instability occurs that is too high, to make the composition translucent or clear, or, when the composition is clear, e.g., at ambient temperature, or down to a specific temperature, to reduce the temperature at which phase instability occurs, preferably by at least about 5° C., more preferably by at least about 10° C. The principal solvent is efficient in that it provides the maximum advantage for a given weight of solvent. It is understood that "solvent", as used herein, refers to the effect of the principal solvent and not to its physical form at a given temperature, since some of the principal solvents are solids at ambient temperature.

Principal solvents that can be present are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature.

However, the logp values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logp values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.-Chim. Theor., 19, 71 (1984).

The principal solvents herein are selected from those having a ClogP of from −2.0 to 2.6, preferably from −1.7 to 1.6, and more preferably from −1.0 to 1.0., The most preferred solvents can be identified by the appearance of the dilute treatment compositions used to treat fabrics. These dilute compositions have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; monols; derivatives of glycerine; alkoxylates of diols; and mixtures of all of the above can be found in said U.S. Pats. Nos. 5,759,990 and 5,747,443 and PCT application WO 97/03169 published on 30 Jan. 1997, said patents and application being incorporated herein by reference, the most pertinent disclosure appearing at pages 24–82 and 94–108 (methods of preparation) of the said WO 97/03169 specification and in columns 11–54 and 66–78 (methods of preparation) of the '443 patent. The '443 and PCT disclosures contain reference numbers to the Chemical Abstracts Service Registry numbers (CAS No.) for those compounds that have such a number and the other compounds have a method described, that can be used to prepare the compounds. Some inoperable solvents listed in the '443 disclosure can be used in mixtures with operable solvents and/or with the high electrolyte levels and/or phase stabilizers, to make concentrated fabric softener compositions that meet the stability/clarity requirements set forth herein.

Many diol solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos: 146452-51-9; 146452-50-8; 14645249-5; 146452-484; 123807-34-1; 123807-33-0; 123807-32-9; and 123807-31-8.

In the '443 and PCT specifications, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

There is a clear similarity between the acceptability (formulatability) of a saturated diol and its unsaturated homologs, or analogs, having higher molecular weights. The unsaturated homologs/analogs have the same formulatability as the parent saturated solvent with the condition that the unsaturated solvents have one additional methylene (viz, $CH_2$) group for each double bond in the chemical formula. In other words, there is an apparent "addition rule" in that for each good saturated solvent of this invention, which is suitable for the formulation of clear, concentrated fabric softener compositions, there are suitable unsaturated solvents where one, or more, $CH_2$ groups are added while, for each $CH_2$ group added, two hydrogen atoms are removed from adjacent carbon atoms in the molecule to form one carbon—carbon double bond, thus holding the number of hydrogen atoms in the molecule constant with respect to the chemical formula of the "parent" saturated solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz, about 0.48, thus about compensating for the —$CH_2$— addition. Therefore one goes from a preferred saturated solvent to the preferred higher molecular weight unsaturated analogs/homologs containing at least one more carbon atom by inserting one double bond for each additional $CH_2$ group, and thus the total number of hydrogen atoms is kept the same as in the parent saturated solvent, as long as the ClogP value of the new solvent remains within the effective range. The following are some illustrative examples:

It is possible to substitute for part of the principal solvent mixture a secondary solvent, or a mixture of secondary solvents, which by themselves are not operable as a principal solvent of this invention, as long as an effective amount of the operable principal solvents of this invention is still present in the liquid concentrated, clear fabric softener composition. An effective amount of the principal solvents of this invention is at least greater than about 1%, preferably more than about 3%, more preferably more than about 5% of the composition, when at least about 15% of the softener active is also present.

Principal solvents preferred for improved clarity at 50° F. are 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

C. Electrolyte

The use of electrolyte, especially in large amounts in a clear fabric softener formulation would not be expected to provide a benefit. Electrolytes and high levels of water insoluble compounds would be expected to be incompatible. The compositions of this invention contain a relatively high level of electrolyte, e.g., from about 0.5% to about 10%, preferably from about 0.75% to about 3%, and more preferably from about 1% to about 2%, by weight of the composition. Increasing the electrolyte level provides at least one benefit selected from (a) lowers the amount of principal solvent having a ClogP of from about 0.15 to about 0.64 or 1, which is required to provide clarity (It can eliminate the need for such a principal solvent completely.); (b) modifies the viscosity/elasticity profile on dilution, to provide lower viscosity and/or elasticity; and (c) modifies the range of ClogP of acceptable principal solvents that will provide clarity/translucency. U.S. Pat. No. 5,759,990, incorporated herein by reference, discloses that the principal solvent should have a ClogP of from about 0.15 to about 0.64. A high electrolyte level allows the use of principal solvents with a ClogP within ranges having progressively more preferred lower limits of: −2.0; −1.7; −1.0; and 0.15 and having progressively more preferred upper limits of: 2.6; 2.0; 1.6; 1.0; and 0.64. This is a totally unobvious and very important benefit, since many of the solvents that are included in this broader range are more readily available, have lower odors, and can be more effective. The existing principal solvents are also more effective with the high electrolyte level, thus allowing one to use less of such principal solvents. Above a ClogP of about 1.6, the use of additional solvents and/or other materials to aid in clarification is highly desirable.

It is believed that electrolytes significantly modify the microstructures and/or alter the phases that the products dilute through compared to products with no or lowered levels of electrolyte. Cryogenic Transmission Electron Microscopy and Freeze-Fracture Transmission Electron Microscopy methods show that in products which gel or have an unacceptable increase in viscosity upon dilution, a highly concentrated, tightly packed dispersion of vesicles can be formed. Such vesicular dispersions are shown to have high elasticity using rheological measurements. It is believed that since these solutions have high elasticity, they resist the mechanical stress that can lead to effective mixing with water and thus good dilution.

It is therefore believed that fabric softener compositions with highly preferred dilution and dispensing behaviors can be identified by evaluating the visco-elastic behavior of a series of water dilutions of the fabric softener composition, or alternatively, by evaluating the visco-elastic properties of the maximum viscosity peak in the dilution series. The visco-elastic behavior of the fabric softening composition provides information on the tendency of the fabric softener composition to flow and disperse in a desirable manner when used by the consumer. Viscosity measures the ability of a fluid to flow (ie. dissipate heat) when energy is applied, represented by G', the loss modulus. Elasticity, which is commonly denoted by the storage modulus G', measures the tendency of the fabric softener composition to be easily deformed as energy is applied. G' and G" are generally measured as functions of applied strain or stress. For the purposes of this invention, G' and G" are measured over a range of energy inputs which encompasses energies likely to be applied in common consumer practices (e.g., machine wash and hand wash processes, pre-dilution steps by hand and machine, machine dispenser use and machine-independent dispenser use). Measuring G' and G" on diluted compositions with maximum viscosity adequately distinguishes fabric softener compositions that have preferred and highly preferred dilution and dispersion behaviors from fabric softener compositions which have less preferred behavior. Further details on Theological parameters as well as well as guidance for choosing instrumentation and making theological measurements is available in the article on Rheology Measurements in the *Kirk-Othmer Encyclopedia of Chemical Technology* 3*rd Ed*., 1982, John Wiley & Sons Publ.; *Rheology of Liquid Detergents* by R. S. Rounds in Surfactant Series Vol. 67*: Liquid Detergents* ed. K.-Y. Lai, Marcel Dekker, Inc. 1997; and *Introduction to Rheology*, Elsevier, 1989, H. A. Barnes, J. F. Hutton, and K. Walters.

It was discovered that there was a previously unrecognized problem that appeared when some clear formulas were diluted. Previously it was believed that the principal solvents promoted facile dilution of clear concentrated formulas to less concentrated dispersions in the rinse liquor. However, when some formulas, especially those with lower levels of principal solvent, or formulas based on solvents which are not principal solvents, are diluted, they have unacceptable viscosity/elasticity profiles. Rheological parameters which describe preferred formulations are as follows: preferred G'≦about 20 Pa and G"≦about 6 Pa sec; more preferred G'≦about 3 Pa and G"≦about 2 Pa sec; even more preferred G'≦about 1 Pa G"≦about 1 Pa, as measured on diluted formulations with maximum viscosity. Dilutions of preferred, more preferred, and yet even more preferred formulas must maintain stated G' and G" values over a range of applied strains from about 0.1 to about 1.

Microscopy shows again that high electrolyte levels allow the creation of formulas at much lower solvent/softener levels that dilute through different microstructures and/or phases which have much lower visco-elasticity. It is believed that microstructures with much lower elasticity, easily yield to slight stresses caused by agitating water in a washing machine, automatic washing machine dispenser, or automatic dispensing device not affixed to the machine agitator such as the Downy® 'Ball'. This leads to good mixing with water and consequently good dispersion of the fabric softener composition and thus reduced fabric staining potential, less fabric softener composition residue left behind in machine or machine-independent dispensing devices, less build-up of fabric softener residue in dispensers, more fabric softener available in the rinse increasing deposition on clothes, more uniform deposition over the surface of all clothes.

The electrolytes herein include the usual ones found in opaque, dispersion-type, liquid fabric softener compositions and others that are not normally used in such compositions. It was previously believed that principal solvents were increasing the flexibility of both the fabric softener domain and the water domain and thus promoting the formation of a highly fluid, optically clear, compositions containing a bicontinuous fabric softener active phase. Unexpectedly, it is now found that electrolytes seem to provide the function of increasing the flexibility of the water domain through breaking up the hydrogen bond interactions via complexation with the water molecules. This appears to be the mechanism by which the use of high electrolyte allows the use of lower amounts of principal solvents and increases the range of operable principal solvents.

Although it is believed that electrolytes function by complexing with water and breaking the hydrogen bond structure of water, it is also believed that the head groups of the fabric softener active and the phase stabilizer must be able to complex with water to increase the steric repulsion that will prevent coalescence of the separate bicontinuous phases of fabric softener actives, thus improving the stability of the typical bicontinuous phase that is present when the fabric softener active is in a clear composition. Electrolytes that have anions that are termed "soft" or "polarizable" anions as discussed in Surfactants and Interfacial Phenomena, Second Edition, M. J. Rosen, pp. 194–5, are more preferred than "hard" or "less polarizable" anions because the polarizable anions are believed to be effective at breaking up the water structure without dehydrating the head groups of the fabric softeners and the phase stabilizers. An additional reason for preferring soft, polarizable anions is that these complex less strongly than the hard ions with the fabric softener cation and so we believe a stronger cationic charge is maintained on the fabric softener head groups in the presence of the soft anions. A stronger cationic charge on the fabric softener should also help stabilize the bicontinuous phase by preventing coalescence through maintaining greater electrostatic repulsion. A typical series of anions from soft to hard is: iodide; bromide; isocyanate; orthophosphate; chloride; sulfate; hydroxide; and fluoride. The harder anions lower the cloud point of conventional ethoxylated nonionic detergent surfactants more, showing that the harder anions tend to dehydrate the head groups of the ethoxylated surfactants used as phase stabilizers.

For example, salts that lower the cloud point of a 1% solution of Neodol® 91-8 to less than about 65° C. are less preferred in the fabric softener compositions described herein because the fabric softener compositions made with these salts tend to be cloudy at ambient temperatures. Typical approximate cloud points for such a solution are: sodium sulfate—about 54.1° C.; potassium sulfate—64.4° C.; ammonium sulfate—about 64.4° C.; calcium sulfate (no change—insoluble); magnesium sulfate—about 58.7° C.; sodium chloride—about 63–66.9° C.; potassium chloride—about 73.4° C.; ammonium chloride—about 73.8° C.; calcium chloride—about 73.8° C.; and magnesium chloride—about 69.8° C. Potassium acetate provides a cloud point of about about 69.8° C., thus placing the acetate anion somewhere between the chloride and sulfate anions.

Inorganic salts suitable for reducing dilution viscosity include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_301$, sodium zirconate, $CaF_2$, $CaCl_2$, $CaBr_2$, $CaCl_2$, $CaSO_4$, $Ca(NO_3)_2$, Ca, KI, KBr, KCl, KF, $KNO_3$, $KIO_3$; $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium alum $AlK(SO_4)_2$, and salts with mixed anions, e.g. potassium tetrachloroaluminate and sodium tetrafluoroaluminate. Salts incorporating cations from groups IIIa, IVa, Va, VIIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or Ha with atomic numbers >20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.5% to about 5% by weight, more preferably from about 0.75% to about 2.5%, and most preferably from about 1% to about 2% by weight of the fabric softener composition.

D. Phase Stabilizer

Phase stabilizers are highly desirable, and can be essential, to formulating a clear or translucent fabric softener composition (product) with high electrolyte levels. It is believed that clear and translucent products are comprised of surfactants strut in bilayers with an aqueous domain between these bilayers. Oily materials, such as hydrophobic perfumes, can be incorporated within the bilayers between the surfactant tails. In fact, these oily materials can act to stabilize the bilayers if the amount present is not excessive. Water soluble compounds, such as the electrolytes described above tend to stay in the aqueous domain between the bilayers.

It is believed that in cationic softener products with no or low electrolyte levels, the surfactant structure is normally stabilized by the electrostatic repulsion between the bilayers. Electrostatic repulsion prevents the surfactant bilayers from coalescing and thus splitting into separate phases. When a high level of electrolyte is added to the formula, it is believed that the electrostatic repulsion between bilayers is diminished and this can promote coalescence of the surfactant bilayers. If this coalescence occurs, one, or more, phase stabilizers is added to the formula to provide more stability, e.g., by steric repulsion between the bilayers.

Typical levels of phase stabilizer in the softening compositions are from an effective amount up to about 15% by weight, preferably from about 0.1% to about 7% by weight, more preferably from about 1% to about 5% by weight of the composition.

The phase stabilizer compounds described herein differ from the principal solvents described hereinbefore by their ability to provide steric repulsion at the interface. These phase stabilizers are not principal solvents as defined herein.

The phase stabilizers useful in the compositions of the present invention are selected surface actives materials commonly comprise of hydrophobic and hydrophilic moieties. A preferred hydrophilic moiety is polyalkoxylated group, preferably polyethoxylated group.

Preferred phase stabilizers are nonionic surfactants derived from saturated and/or unsaturated primary, secondary, and/or branched, amine, amide, amide-oxide, fatty alcohol, fatty acid, alkyl phenol, and/or alkyl aryl carboxylic acid compounds, each preferably having from about 6 to about 22, more preferably from about 8 to about 18; carbon atoms in a hydrophobic chain, more preferably an alkyl or alkylene chain, wherein at least one active hydrogen of said compounds is ethoxylated with ≦50, preferably ≦30, more preferably from about 5 to about 15, and even more preferably from about 8 to about 12, ethylene oxide moieties to provide an HLB of from about 8 to about 20, preferably from about 10 to about 18, and more preferably from about 11 to about 15.

Suitable phase stabilizers also include nonionic surfactants with bulky head groups selected from:

a. surfactants having the formula $$R^1—C(O)—Y'—[C(R^5)]_m—CH_2O(R_2O)_2H$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein $0 \leqq x \leqq$ about 3 and z is from about 5 to about 30; each $R^2$ is selected from the following groups or combinations of the following groups: $—(CH_2)_n—$ wherein n is from about 1 to about 4 and/or $—[CH(CH_3)CH_2]—$; and each $R^5$ is selected from the following groups: —OH; and $—O(R^2O)_z—H$; and m is from about 2 to about 4;

b. surfactants having the formulas:

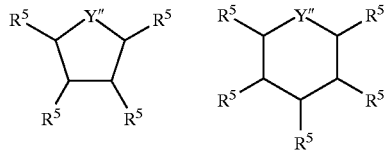

wherein Y"=N or O; and each $R^5$ is selected independently from the following: —H, —OH, $—(CH_2)xCH_3$, $—O(OR^2)_z—H$, $—OR^1$, $—OC(O)R^1$, and $—CH(CH_2—(OR^2)_{z''}—H)—CH_2—(OR^2)_{z'}—C(O)R^1$, x and $R^1$ are as defined above and $5 \leqq z, z', \text{and } z'' \leqq 20$, more preferably $5 \leqq z+z'+z'' \leqq 20$, and most preferably, the heterocyclic ring is a five member ring with Y"=O, one $R^5$ is —H, two $R^5$ are $—O—(R^2O)z—H$, and at least one $R^5$ is the following structure $—CH(CH_2—(OR^2)_{z''}—H)—CH_2—(OR)_{z'}—C(O)R^1$ with $8 \leqq z+z'+z'' \leqq 20$ and $R^1$ is a hydrocarbon with from 8 to 20 carbon atoms and no aryl group;

C. polyhydroxy fatty acid amide surfactants of the formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each $R^1$ is H or a cyclic mono- or polysaccharide, or alkoxylated derivative thereof; and d. mixtures thereof.

Suitable phase stabilizers also include surfactant complexes formed by one surfactant ion being neutralized with surfactant ion of opposite charge or an electrolyte ion that is suitable for reducing dilution viscosity and block copolymer surfactants comprising polyethylene oxide moieties and propylene oxide moieties Examples of representative phase stabilizers include:

(1)—Alkyl or Alkyl-Aryl Alkoxylated Nonionic Surfactants

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with ≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of ≦about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25–9,1-9, 25–12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF.

Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF.

(2)—Alkyl or Alkyl-Aryl Amine or Amine Oxide Nonionic Alkoxylated Surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦about 50 moles alkylene oxide moieties (e.g. ethylene oxide and/or propylene oxide) per mole of amine. The amine or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Preferably, the compounds of the alkyl or alkyl-aryl alkoxylated surfactants and alkyl or alkyl-aryl amine and amine-oxide alkoxylated have the following general formula:

$$R^1{}_m—Y—[(R^2—O)—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: $—(CH_2)_n—$ and/or $—[CH(CH_3)CH_2]—$; wherein about 1<n≦about 3; Y is selected from the following groups: —O—; $—N(A)_q—$; —C(O)O—; $—(O\leftarrow)N(A)_q—$; $—B—R^3—O—$; $—B—R^3—N(A)_q—$; $—B—R^3—C(O)O—$; $—B—R^3—N(\rightarrow O)(A)—$; and mixtures thereof; wherein A is selected from the following groups: H; $R^1$; $—(R^2—O)_z—H$; $—(CH_2)_x CH_3$; phenyl, or substituted aryl, wherein 0≦x≦about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and 5≦z≦30, and q can be 1 or 0, but when p=2, q must be 0; more preferred are structures in which m=1, p=1 or 2, and 7≦z≦20; and even more preferred are structures in which m 1, p=1 or 2, and 9≦z≦12. The preferred y is 0.

(3)— Alkoxylated and Non-Alkoxylated Nonionic Surfactants with Bulky Head Groups Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦about 50, preferably ≦about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of ≦about 50, preferably ≦about 30, moles of carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH2)_n—$ and/or $—[CH(CH_3)CH_2]—$; and each $R^5$ is selected from the following groups: —OH; and $—O(R^2O)_z—H$; and m is from about 2 to about 4;

Another useful general formula for this class of surfactants is

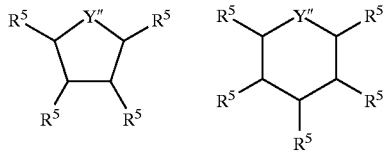

wherein Y"=N or O; and each $R^5$ is selected independently from the following: —H, —OH, $—(CH_2)xCH_3$, $—(OR^2)_x—H$, $—OR^1$, $—OC(O)R^1$, and $—CH_2$ $(CH_2—OR^2)_{z''}—H)—CH_2—(OR^2)_{z'}—C(O)R^1$. With x, $R^1$, and $R^2$ as defined above in section D above and z, z', and z" are all from about 5≦to ≦about 20, more preferably the total number of z+z'+z" is from about 5≦to ≦about 20. In a particularly preferred form of this structure the heterocyclic ring is a five member ring with Y"=0, one $R^5$ is —H, two $R^5$ are $—O—(R^2O)_z—H$, and at least one $R^5$ has the following structure $—CH(CH_2—(OR^2)_z—H)—CH_2—(OR^2)_z—OC(O)R^1$ with the total z+z'+z"=to from about 8≦to ≦about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—Z$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably Cl alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl moiety having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl moiety. Z preferably will be selected from the group consisting of $—CH_2—(CHOH)_n—CH_2OH$, $—CH(CH_2OH)—(CHOH)_n—CH_2OH$, $—CH_2—(CHOH)_2(CHOR^1)(CHOH)—CH_2OH$, where n is an integer from 3 to 5, inclusive, and $R^1$ is H or a cyclic mono- or poly-saccharide, and alkoxylated derivatives thereof. Most preferred are glycityls wherein n is 4, particularly $—CH_2—(CHOH)_4—CH_2O$. Mixtures of the above Z moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6—CO—N$≦can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(4)—Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≦about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than ≦about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≦about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. and/or do not solidify in these clear formulations. Examples of suitable phase stabilizers of this type include Ethoquad® 18/25, C/25, and 0/25 from Akzo and Variquat-66 (soft tallow alkyl bis(polyoxyethyl) ammonium ethyl sulfate with a total of about 16 ethoxy units) from Witco.

Preferably, the compounds of the ammonium alkoxylated cationic surfactants have the following general formula:

$$\{R^1m—Y—[(R^2—O)_z—H]_p\}^{+X^-}$$

wherein $R^1$ and $R^2$ are as defined previously in section D above;

Y is selected from the following groups: $=N^+—(A)_q$; $—(CH_2)_n—N^+—(A)_q$; $—B—(CH_2)_n—N^+—(A)_2$; -(phenyl)-$N^+—(A)_q$; —(B-phenyl)$N^+—(A)_q$; with n being from about 1 to about 4, m is 1 or 2, p is 1 or 2, and m+p+q=4.

Each A is independently selected from the following groups: H; $R^1$; $(R^2O)_z—H$; $—(CH_2)_xCH_3$; phenyl, and substituted aryl; where 0≦x≦about 3; and B is selected from the following groups: —O—; —NA—; $—NA_2$; —C(O)O—; and —C(O)N(A)—; wherein $R^2$ is defined as hereinbefore; q=1 or 2; and $X^-$ is an anion which is compatible with fabric softener actives and adjunct ingredients.

Preferred structures are those in which m=1, p=1 or 2, and about 5≦z≦about 50, more preferred are structures in which m 1, p 1 or 2, and about 7≦z≦about 20, and most preferred are structures in which m=1, p 1 or 2, and about 9≦z≦about 12.

(5)—Surfactant Complexes

Surfactant complexes are considered to be surfactant ions neutralized with a surfactant ion of opposite charge or a surfactant neutralized with an electrolyte that is suitable for reducing dilution viscosity, an ammonium salt, or a polycationic ammonium salt. For the purpose of this invention, if a surfactant complex is formed by surfactants of opposite charge, it is preferable that the surfactants have distinctly different chain lengths e.g. a long-chain surfactant complexed with a short-chain surfactant to enhance the solubility of the complex and it is more preferable that the that the long chain surfactant be the amine or ammonium containing surfactant. Long chain surfactants are defined as containing alkyl chains with from about 6 to about 22 carbon atoms. These alkyl chains can optionally contain a phenyl or substituted phenyl group or alkylene oxide moieties between the chain and the head group. Short chain surfactants are defined as containing alkyl chains with less than 6 carbons and optionally these alkyl chains could contain a phenyl or substituted phenyl group or alkylene oxide moieties between the alkyl chain and the head group. Examples of suitable surfactant complexes include mixtures of Armeen® APA-10 and calcium xylene sulfonate, Armeen APA-10 and magnesium chloride, lauryl carboxylate and triethanol amine, linear alkyl benzene sulfonate and $C_5$-dimethyl amine, or alkyl ethoxylated sulfate and tetrakis N,N,N'N' (2-hydroxylpropyl) ethylenediamine.

Preferably, long-chain surfactants for making complexes have the following general formula:

$$R^1—Y^2$$

wherein $R^1$ is as hereinbefore from section D above and $Y^2$ can be chosen from the following structures: $—N(A)_2$; $—C(O)N(A)_2$; $—(O\leftarrow)N(A)_2$; $—B—R^3—N(A)_2$; $—B—R^3—C(O)N(A)_2$; $—B—R^3—N(\rightarrow O)(A)_2$; $—CO_2$; $—SO_3^{-2}$; $—OSO_3^{-2}$; $—O(R^2O)_xCO_2^-$; $—O(R^2O)_xSO_3^{-2}$; and $—O(R^2O)_xOSO_3^{-2}$; with B and $R^3$ as is hereinbefore section D above and $0 \leqq x \leqq 4$.

Preferably, short-chain surfactants for making complexes have the following general formula:

$$R^4—Y^2$$

wherein $R^1$, $R^3$, B, and $Y^2$ are as hereinbefore and $R^4$ can be chosen from the following: $(CH_2)_yCH_3$; $—(CH_2)_y$-phenyl or $—(CH_2)_y$-substituted phenyl with $0 \leqq y \leqq 6$ (6)—Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred polymers have the generic formula:

$$X—(OCH_2CH_2)_n—[O—C(O)—R^1—C(O)—R^2)_u—[O—C(O)—R^1—C(O)—O)—(CH_2CH_2O)_n—X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/polyoxyethylene/polyoxypropylene (PO/EO/PO) reverse block polymers.

The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

Other of block copolymers include the polyalkylene oxide polysiloxanes having a dimethyl polysiloxane hydrophobic moiety and one or more hydrophilic polyalkylene side chains, and having the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the sane or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) copolymer group.

Nonlimiting examples of this type of surfactants are the Silwet® surfactants which are available OSi Specialties, Inc., Danbury, Conn. Representative Silwet surfactants which contain only ethyleneoxy ($C_2H_4O$) groups are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |

Nonlimiting examples of surfactants which contain both ethyleneoxy ($C_2H_4$ 0) and propyleneoxy ($C_3H_6$ 0) groups are as follows.

| Name | Average MW | EO/PO ratio |
|---|---|---|
| Silwet L-720 | 12,000 | 50/50 |
| Silwet L-7001 | 20,000 | 40/60 |
| Silwet L-7002 | 8,000 | 50/50 |
| Silwet L-7210 | 13,000 | 20/80 |
| Silwet L-7200 | 19,000 | 75/25 |
| Silwet L-7220 | 17,000 | 20/80 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_{40}$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Surfactants which contain only propyleneoxy groups without ethyleneoxy groups are not preferred. Preferred Silwet surfactants are L-7600, L-7602, L-7604, L-7605, L-7657, and mixtures thereof. Besides surface activity, polyalkylene oxide polysiloxane surfactants can also provide other benefits, such as antistatic benefits, lubricity and softness to fabrics.

The preparation of polyalkylene oxide polysiloxanes is well known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

(7)—Alkyl Amide Alkoxylated Nonionic Surfactants

Suitable surfactants have the formula:

$$R—C(O)—N(R^4)_n—[(R^1O)_x(R^2O)_yR^3]_m$$

wherein R is $C_{7-21}$, linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is $—CH_2—CH2—$, $R_2$ is $C_3$–$C_4$ linear alkyl, $C_3$–$C_4$ branched alkyl, and mixtures thereof; preferably $R^2$ is $—CH(CH_3)CH_2—$. Surfactants which comprise a mixture of R1 and R2 units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to R2 units is from about 4:1 to about 8:1. Preferably an $R^2$ unit (i.e. $—C(CH_3)H—CH_2—$) is attached to the nitrogen atom followed by the balance of the chain comprising from about 4 to 8$—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the R4 unit is absent.

The index m is 1 or 2, the index n is 0 or 1, provided that m+n equals 2; preferably m is equal to 1 and n is equal to 1, resulting in one —$[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT/60 from Akzo.; and (8).—Mixtures Thereof.

In terms of principal solvent reduction, with the invention compositions, a reduction of at least 30% can be made without impairing the performance of the composition compared to compositions without the phase stabilizers hereinbefore described. Using a preferred sub-class, a reduction of more than 50% is possible. These phase stabilizers provide an improved range of temperatures at which the compositions are clear and stable. They also allow more electrolyte to be used without instability. Finally, they can reduce the amount of principal solvent needed to achieve clarity and/or stability.

In order to reduce the amount of principal solvent used, the preferred phase stabilizers are alkoxylated alkyls, alkoxylated acyl amides, alkoxylated alkyl amines or alkoxylated quaternary alkyl ammonium salts, surfactant complexes, and mixtures thereof. The various stabilizers have different advantages. For example, alkoxylated cationic materials or cationic surfactant complexes improve softness and provide enhanced wrinkle release benefits.

For systems where the softener active compound is di(acyloxyethyl)(2-hydroxyethyl)methyl ammonium methyl sulfate, where the acyl group is derived from partially hydrogenated canola fatty acid, it has been found that the preferred level of stabilizer for optimum clarity and stability increases with increasing level of principal solvent and optional perfume, and decreases with increasing levels of softener active.

Fabric softener compositions with highly preferred dilution and dispensing behaviors can be identified as disclosed hereinbefore.

Optional Ingredients (a). Perfume

The present invention can contain any softener compatible perfume. Suitable perfumes are disclosed in U.S. Pat. Nos. 5,500,138 and 5,652,206, Bacon et al., issued Mar. 19, 1996 and Jul. 29, 1997 respectively, said patents being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, those materials disclosed in said patents.

The perfumes useful in the present invention compositions are preferably substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 15%, preferably from about 0.1% to about 8%, and more preferably from about 0.2% to about 5%, by weight of the finished composition. Fabric softener compositions of the present invention provide improved fabric perfume deposition.

(b). Principal Solvent Extender

The compositions of the present invention can optionally include a principal solvent extender to enhance stability and clarity of the formulations and in certain instances provide increased softness benefits. The solvent extender is typically incorporated in amounts ranging from about 0.05% to about 10%, more preferably from about 0.5% to about 5% and most preferably from about 1% to about 4% by weight of the composition.

The principal solvent extender may include a range of materials with proviso that the material provide stability and clarity to a compositions having reduced principal solvent levels and typically reduced perfume or fragrance levels. Such materials typically include hydrophobic materials such as polar and non-polar oils, and more hydrophilic materials like hydrotropes and electrolytes as disclosed above, e.g. electrolytes of groups IIB, III and IV of the periodic table in particular electrolytes of groups IIB and IIIB such as aluminum, zinc, tin chloride electrolytes, sodium EDTA, sodium DPTA, and other electrolytes used as metal chelators.

Polar hydrophobic oils may be selected from emollients such as fatty esters, e.g. methyl oleates, Wickenols®, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicylate, diethyl or dibutyl phthalate; bulky alcohols or diols; and perfume oils particularly low-odor perfume oils such as linalool; mono or poly sorbitan esters; and mixtures thereof. Non-polar hydrophobic oils may be selected from petroleum derived oils such as hexane, decane, penta decane, dodecane, isopropyl citrate and perfume bulky oils such as limonene, and mixtures thereof. In particular, the free fatty acids such as partially hardened canola oil may provide increased softness benefits.

Particularly preferred hydrophobic oils include the polar hydrophobic oils. In particular, polar hydrophobic oils which have a freezing point, as defined by a 20% solution of the extender in 2,2,4-trimethyl-1,3-pentanediol, of less than about 22° C. and more preferably less than about 20° C. Preferred oils in this class include methyl oleate, benzyl benzoate and canola oil.

Suitable hydrotropes include sulfonate electrolytes particularly alkali metal sulfonates and carboxylic acid derivatives such as isopropyl citrate. In particular, sodium and calcium cumene sulfonates and sodium toluene sulfonate. Alternative hydrotropes include benzoic acid and its derivatives, electrolytes of benzoic acid and its derivatives.

(c). Cationic Charge Boosters

Cationic charge boosters may be added to the rinse-added fabric softening compositions of the present invention if needed. Some of the charge boosters serve other functions as described hereinbefore. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition.

The preferred cationic charge boosters of the present invention are described herein below.

(i) Quanternary Ammonium Compounds

A preferred composition of the present invention comprises at least about 0.2%, preferably from about 0.2% to about 10%, more preferably from about 0.2% to about 5% by weight, of a cationic charge booster having the formula:

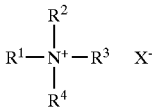

wherein $R^1$, $R^2$, $R^3$, and $R^4$ are each independently $C_1$–$C_{22}$ alkyl, $C_3$–$C_{22}$ alkenyl, $R^5$—Q—$(CH2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$—Q—$(CH2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH_2)_m$— moiety has the formula:

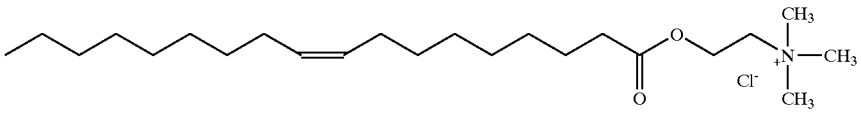

wherein $R^5$—Q— is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

(ii) Polyvinyl Amines

A preferred composition according to the present invention contains at least about 0.2%, preferably from about 0.2% to about 5%, more preferably from about 0.2% to about 2% by weight, of one or more polyvinyl amines having the formula

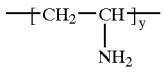

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —$NH_2$ unit hydrogens can be substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

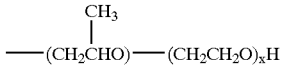

wherein x has the value of from 1 to about 50. Substitutions such as the above are represented by the abbreviated formula PO—$EO_x$—. However, more than one propyleneoxy unit can be incorporated into the alkyleneoxy substituent.

Polyvinyl amines are especially preferred for use as cationic charge booster in liquid fabric softening compositions since the greater number of amine moieties per unit weightprovides substantial charge density. In addition, the cationic charge is generated in situ and the level of cationic charge can be adjusted by the formulator.

(iii) Polyalkyleneimines

A preferred composition of the present invention comprises at least about 0.2%, preferably from about 0.2% to about 10%, more preferably from about 0.2% to about 5% by weight, of a polyalkyleneimine charge booster having the formula:

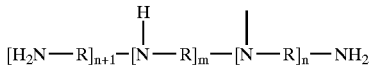

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the ratio of primary:secondary:tertary amine moieties, that is the ratio of —$RNH_2$, —RNH, and —RN moieties, is 1:2:1.

R units are $C_2$–$C_8$ alkylene, $C_3$–$C_8$ alkyl substituted alkylene, and mixtures thereof, preferably ethylene, 1,2-propylene, 1,3-propylene, and mixtures thereof, more preferably ethylene. R units serve to connect the amine nitrogens of the backbone.

Optionally, one or more of the polyvinyl amine backbone —$NH_2$ unit hydrogens can be substituted by an alkyleneoxy unit having the formula:

$$-(R^1O)_xR^2$$

wherein $R^1$ is $C_2$–$C_4$ alkylene, $R^2$ is hydrogen, $C_1C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

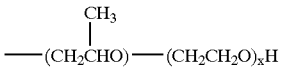

wherein x has the value of from 1 to about 50. Substitutions such as the above are represented by the abbreviated formula PO—$EO_x$—. However, more than one propyleneoxy unit can be incorporated into the alkyleneoxy substituent.

The preferred polyamine cationic charge boosters suitable for use in rinse-added fabric softener compositions comprise backbones wherein less than 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The cationic charge boosting polyamines of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

The PEI's which comprise the preferred backbones of the charge boosters of the present invention can be prepared, for example, by polymerizing ethyleneimine in the presence of a catalyst such as carbon dioxide, sodium bisulfite, sulfuric acid, hydrogenperoxide, hydrochloric acid, acetic acid, etc, Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

(iv) Poly-Quaternary Ammonium Compounds

A preferred composition of the present invention comprises at least-about 0.2%, preferably from about 0.2% to about 10%, more preferably from about 0.2% to about 5% by weight, of a cationic charge booster having the formula:

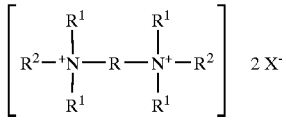

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$—Q-$(CH2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is an anion.

Preferably R is ethylene; $R^1$ is methyl or ethyl, more preferably methyl; at least one $R^2$ is preferably $C_1$–$C_4$ alkyl, more preferably methyl. Preferably at least one $R^2$ is $C_1$–$C_{22}$ alkyl, $C_{11}$–$C_{22}$ alkenyl, and mixtures thereof.

The formulator may similarly choose $R^2$ to be a $R^5$—Q-$(CH_2)_m$— moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$—Q—$(CH2)_m$-moiety has the formula:

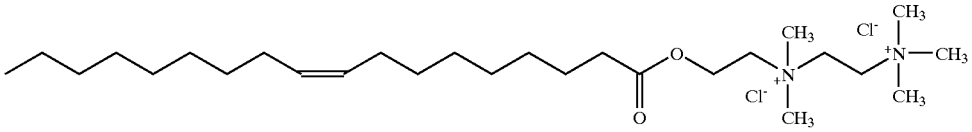

wherein $R^1$ is methyl, one $R^2$ units is methyl and the other $R^2$ unit is $R^5$—Q—$(CH_2)_m$— wherein $R^5$—Q— is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

(v). Cationic Polymers

Composition herein can contain from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and copolymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary, Fourth Edition, J. M. Nikitakis, et al, Editors, published by the Cosmetic, Toiletry, and Fragrance Association, 1991, incorporated herein by reference.

The list includes the following:

Of the polysaccharide gums, guar and locust bean gums, which are galactomannan gums are available commercially, and are preferred. Thus guar gums are marketed under Trade Names CSAA M1200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name-Meyhall). Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

Some very effective individual cationic polymers are the following: Polyvinyl pyridine, molecular weight about 40,000, with about 60% of the available pyridine nitrogens quaternized. Copolymer of 70/30 molar proportions of vinyl pyridine/styrene, molecular weight about 43,000, with about 45% of the available pyridine nitrogens quaternized as above; Copolymers of 60/40 molar proportions of vinyl pyridine/acrylamide, with about 35% of the available pyridine nitrogens quaternized as above. Copolymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene copolymer about 0.05%.

Some other effective cationic polymers are: Copolymer of vinyl pyridine and N-vinyl pyrrolidone (63/37) with about 40% of the available pyridine nitrogens quaternized. Copolymer of vinyl pyridine and acrylonitrile (60/40), quaternized as above. Copolymer of N,N-dimethyl amino ethyl methacrylate and styrene (55/45) quaternized as above at about 75% of the available amino nitrogen atoms. Eudragit E (Trade Name of Rohm GmbH) quaternized as above at about 75% of the available amino nitrogens. Eudragit E is believed to be copolymer of N,N-dialkyl amino alkyl methacrylate and a neutral acrylic acid ester, and to have molecular weight about 100,000 to 1,000,000. Copolymer of N-vinyl pyrrolidone and N,N-diethyl amino methyl methacrylate (40/50), quaternized at about 50% of the available amino nitrogens. These cationic polymers can be prepared in a known manner by quaternising the basic polymers.

Yet other cationic polymeric salts are quaternized polyethylenemines. These have at least 10 repeating units, some or all being quaternized. Commercial examples of polymers of this class are also sold under the generic Trade Name Alcostat by Allied Colloids.

Typical examples of polymers are disclosed in U.S. Pat. No. 4,179,382, incorporated herein by reference.

Each polyamine nitrogen whether primary, secondary or tertiary, is further defined as being a member of one of three general classes; simple substituted, quaternized or oxidized.

The polymers are made neutral by water soluble anions such as chlorine ($Cl^-$), bromine ($Br^-$), iodine ($I^-$) or any other negatively charged radical such as sulfate ($SO_4^{2-}$) and methosulfate ($CH_3SO_3^-$).

Specific polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

An example of modified polyamine cationic polymers of the present invention comprising PEI's comprising a PEI backbone wherein all substitutable nitrogens are modified by replacement of hydrogen with a polyoxyalkyleneoxy unit, —$(CH_2CH_2O)_7H$. Other suitable polyamine cationic polymers comprise this molecule which is then modified by subsequent oxidation of all oxidizable primary and secondary nitrogens to N-oxides and/or some backbone amine units are quaternized, e.g. with methyl groups.

Of course, mixtures of any of the above described cationic polymers can be employed, and the selection of individual polymers or of particular mixtures can be used to control the physical properties of the compositions such as their viscosity and the stability of the aqueous dispersions.

(d). Brighteners

The compositions herein can also optionally contain from about 0.005% to about 5% by weight of certain types of hydrophilic optical brighteners which also provide a dye transfer inhibition action. If used, the compositions herein will preferably comprise from about 0.001% to about 1% by weight of such optical brighteners.

The hydrophilic optical brighteners useful in the present invention are those described in said U.S. Pat. No. 5,759,990 at column 21, lines 15–60.

(e). Mono-Alkyl Cationic Quaternary Ammonium Compound

When the mono-long chain alkyl cationic quaternary ammonium compound is present, it is typically present at a level of from about 2% to about 25%, preferably from about 3% to about 17%, more preferably from about 4% to about 15%, and even more preferably from about 5% to about 13% by weight of the composition, the total mono-alkyl cationic quaternary ammonium compound being at least at an effective level to improve softening in the presence of anionic surfactant.

Such mono-alkyl cationic quaternary ammonium compounds useful in the present invention are, preferably, quaternary ammonium salts of the general formula:

$$[R^4N^+(R^5)_3]A^-$$

wherein $R^4$ is $C_9$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group; each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $A^-$ is as defined hereinbefore for (Formula (1)).

Especially preferred are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups. Such linking groups are preferably within from about one to about three carbon atoms of the nitrogen atom.

Mono-alkyl cationic quaternary ammonium compounds also include $C_8$–$C_{22}$ alkyl choline esters. The preferred compounds of this type have the formula:

$$[R^1C(O)—O—CH_2CH_2N^+(R)_3]A^-$$

wherein $R^1$, R and $A^-$ are as defined previously.

Highly preferred compounds include $C_{12}$–$C_{14}$ coco choline ester and $C_{16}$–$C_{18}$ tallow choline ester.

Suitable biodegradable single-long-chain alkyl compounds containing an ester linkage in the long chains are described in U.S. Pat. No. 4,840,738, Hardy and Walley, issued Jun. 20, 1989, said patent being incorporated herein by reference.

Suitable mono-long chain materials correspond to the preferred biodegradable softener actives disclosed above, where only one $R^1$ group is present in the molecule. The $R^1$ group or $YR^1$ group, is replaced normally by an R group.

These quaternary compounds having only a single long alkyl chain, can protect the cationic softener from interacting with anionic surfactants and/or detergent builders that are carried over into the rinse from the wash solution. It is highly desirable to have sufficient single long chain quaternary compound, or cationic polymer to tie up the anionic surfactant. This provides improved softness and wrinkle control. The ratio of fabric softener active to single long chain compound is typically from about 100:1 to about 2:1, preferably from about 50:1 to about 5:1, more preferably from about 13:1 to about 8:1. Under high detergent carry-over conditions, the ratio is preferably from about 5:1 to about 7:1. Typically the single long chain compound is present at a level of about 110 ppm to about 25 ppm in the rinse.

(f). Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents. These assure good odor stability under long term storage conditions. Antioxidants and reductive agent stabilizers are especially critical for unscented or low scent products (no or low perfume).

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox® 6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox®D B 1171; Irganox® 1425; Irganox® 3114; Irganox® 3125; and mixtures thereof; preferably Irganox® 3125, Irganox®

1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

(g). Soil Release Agent

Suitable soil release agents are disclosed in the U.S. Pat. No. 5,759,990 at column 23, line 53 through column 25, line 41. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

These soil release agents can also act as a scum dispersant.

(h). Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon about 1 to about 1,000 ppm by weight of the agent.

(i). Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

The chelating agents disclosed in said U.S. Pat. No. 5,759,990 at column 26, line 29 through column 27, line 38 are suitable.

The chelating agents are typically used in the present rinse process at levels from about 2 ppm to about 25 ppm, for periods from 1 minute up to several hours' soaking.

A preferred EDDS chelator that can be used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a CH2(COOH)$CH_2$(COOH) group.

A wide variety of chelators can be used herein. Indeed, simple polycarboxylates such as citrate, oxydisuccinate, and the like, can also be used, although such chelators are not as effective as the amino carboxylates and phosphonates, on a weight basis.

Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein, in addition to those that are stabilizers. Preferred chelators include DETMP, DETPA, NTA, EDDS, TPED, and mixtures thereof.

(j). Color Care Agent

The composition can optionally comprise from about 0.1% to about 50% of by weight of the composition of a color care agent having the formula:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalk; hydroxyalkyl; polyhydroxyalkyl; polyalkylether having the formula —$((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $(O(CH2)y)_zR_7$; the group —$C(O)R_8$ where $R_8$ is alkyl; alkaryl; arylalk; hydroxyalkyl; polyhydroxyalkyl and polyalkyether as defined in $R_1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalk; hydroxyalkyl; polyhydroxyalkyl; polyalkylether; alkoxy and polyalkoxy as defined in $R_1$, $R_2$, $R_3$, and $R_4$; and either of $R^1$+$R_3$ or $R_4$ or $R_2$+$R_3$ or $R_4$ can combine to form a cyclic substituent.

Preferred agents include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The color care agent has more than about 1% nitrogen by weight of the compound, and preferably more than 7%. A preferred agent is tetrakis-(2-hydroxylpropyl) ethylenediamine (TPED).

(k). Silicones

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without pre-emulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency can be appreciably reduced at high softener levels and/or after multiple cycles. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

The present invention can include other optional components conventionally used in textile treatment compositions, for example: colorants; preservatives; surfactants; anti-shrinkage agents; fabric crisping agents; spotting agents; germicides; fungicides; anti-corrosion agents; enzymes such as proteases, cellulases, amylases, lipases, etc; and the like.

The present invention can also include other compatible ingredients, including those disclosed U.S. Pat. No. 5,686,376, Rusche, et al.; issued Nov. 11, 1997, Shaw, et al.; and U.S. Pat. No. 5,536,421, Hartman, et al., issued Jul. 16, 1996, said patents being incorporated herein by reference.

All parts, percentages, proportions, and ratios herein are by weight unless otherwise specified and all numerical values are approximations based upon normal confidence limits. All documents cited are, in relevant part, incorporated herein by reference.

The following is an example of a softener compound useful in the present invention: TEA Di-ester Quat: Di(acyloxyethyl)(2-hydroxyethyl)methyl ammonium methyl sulfate where the acyl group is derived from partially hydrogenated canola fatty acid 1)—Esterification:

About 536 grams of partly hydrogenated tallow fatty acid with an IV of about 98, a cis/trans ratio (C18:1) and an Acid Value of about 198.5, a special grade of Industrene fatty acid available from Witco Corporation, is added into the reactor, the reactor is flushed with $N_2$ and about 149 grams of triethanolamine is added under agitation. The molar ratio of fatty acid to triethanol amine is of about 1.9:1. The mixture is heated above about 150° C. and the pressure is reduced to remove the water of condensation. The reaction is prolonged until an Acid Value of about 4 is reached.

2)—Quaternization:

To about 645 grams of the product of condensation, about 122 grams of dimethylsulfate is added under continuous agitation. The reaction mixture is kept above about 50° C. and the reaction is followed by verifying the residual amine value. 767 grams of softener compound is obtained.

The quaternized material is optionally diluted with e.g. about 68 g of ethanol and about 68 g of hexylene glycol which lowers the melting point of the material thereby providing a better handling of the material. Additional ingredients can be added to the material at this time including chelants, antioxidants, perfume, etc. Disclosures of such materials and the benefits of including them can be found in U.S. Pat. No. 5,747,443, Wahl, Trinh, Gosselink, Letton, and Sivik, issued May 5, 1998 and in U.S. Pat. No. 5,686,376, Rusche, Baker, and Maashlein, issued Nov. 11, 1997, said patents being incorporated herein by reference.

The above synthesized softener compound is also exemplified below in the non-limiting fabric softening composition examples.

The following non-limiting Examples show clear, or translucent, products with acceptable viscosities. The compositions in the Examples below are made by first preparing an oil seat of softener active at ambient temperature. The softener active can be heated, if necessary, to melting, if the softener active is not fluid at room temperature. The softener active is mixed using an IKA RW 25' mixer for about 2 to about 5 minutes at about 150 rpm. Separately, a water seat is prepared, i.e., with deionized (DI) water at ambient temperature and with optional acid if needed to adjust pH. If the softener active and/or the principal solvent(s) are not fluid at room temperature and need to be heated, the acid/water seat should also be heated to a suitable temperature, e.g., about 100° F. (about 38° C.) and maintaining said temperature with a water bath. The principal solvent(s) (melted at suitable temperatures if their melting points are above room temperature) are added to the softener premix and said premix is mixed for about 5 minutes. Then the optional phase stabilizer(s) are added and mixed for about one minute. Then the electrolyte is added and mixed for about one minute. The water seat is then added to the softener premix and mixed for about 20 to about 30 minutes or until the composition is clear and homogeneous. Last, the perfume is added and mixed until the composition is clear and homogeneous. The composition is allowed to air cool to ambient temperature.

Alternatively, for systems where all components are liquids at room temperature, the compositions are prepared as follows. The components are added in the following order, with thorough mixing after each addition by hand, or with, for example, a Lightnin® 77 mixer for about 2 to about 5 minutes at about 150 rpm: softener active, principal solvent, optional phase stabilizer, water, perfume, and electrolyte (as concentrated aqueous solution).

TABLE 1

Efficiency of Alkyl Ethoxylated Surfactants as Phase Stabilizers

| Component Wt % | 1 | 2 | 3 | 4 | 5 | 6 | 7 | 8 |
|---|---|---|---|---|---|---|---|---|
| TEA Di-ester Quat.[1] | 30 | 30 | 30 | 30 | 30 | 30 | 30 | 30 |
| Ethanol from softener active | 2.47 | 2.47 | 2.47 | 2.47 | 2.47 | 2.47 | 2.47 | 2.47 |
| Hexylene Glycol from softener active | 2.65 | 2.65 | 2.65 | 2.65 | 2.65 | 2.65 | 2.65 | 2.65 |
| TMPD[2] | 6 | 6 | 6 | 6 | 6 | 6 | 6 | 6 |
| Neodol ® Identification[3] | 23-12 | 91-8 | 25-9 | 1-7 | 91-6 | 45-7 | 1-5 | 23-5 |
| HLB value | 14.6 | 13.9 | 13.1 | 12.9 | 12.4 | 11.6 | 11.2 | 10.7 |
| % of Neodol required | 3.66 | 4.18 | 4.4 | 4.88 | 5 | 5.5 | 6.87 | 7.75 |
| $MgCl_2$ | 1.75 | 1.75 | 1.75 | 1.75 | 1.75 | 1.75 | 1.75 | 1.75 |
| Perfume | 1.8 | 1.8 | 1.8 | 1.8 | 1.8 | 1.8 | 1.8 | 1.8 |
| Deionized water | Bal. | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]2,2,4-trimethyl-1,3-pentanediol
[3]Alkyl alkoxylated surfactants trademarked by Shell

25

The efficiency of the alkyl ethoxylated surfactants such as Neodols® correlates well with the HLB (Hydrophilic/Lipophilic Balance) value. The higher the HLB value, the lower the weight percent of Neodol® that is necessary for the composition.

TABLE 2

Fabric Softener Compositions with Various Fabric Softener Levels and Solvent Systems

| 1 | 1 | 2 | 3 | 4 | 5 | 6 | 7 | 8 | 9 |
|---|---|---|---|---|---|---|---|---|---|
| TEA Di-ester Quat.[1] | 30 | 35 | 30 | 30 | 30 | 30 | 35 | 30 | 35 |
| Ethanol (from active) | 2.47 | 2.88 | 2.47 | 2.47 | 2.47 | 2.47 | 2.88 | 2.47 | 2.88 |
| Hexylene Glycol (from active) | 2.7 | 3.1 | 2.7 | 2.7 | 2.7 | 2.7 | 3.1 | 2.7 | 3.1 |
| TMPD | 4 | 5 | — | — | 5 | 5 | — | — | — |
| Hexylene Glycol | — | — | 6 | 6 | — | — | 10 | — | 2 |
| EHD[2] | — | — | — | — | — | — | — | 6 | — |
| Neodol ® 91-8[3] | 5 | 6 | 4 | 4 | 6 | 6 | 5 | 5 | 5 |
| Pluronic ® L-35[4] | 1 | 1 | 1 | — | 1 | 1 | 1 | 1 | 1 |
| HCl | 0–0.25 | 0–0.25 | 0–0.25 | 0–0.25 | 0–0.25 | 0–0.25 | 0–0.25 | 0–0.25 | 0–0.25 |
| $MgCl_2$ | 1.75 | 1.75 | 2.00 | 2.00 | 1.75 | 1.75 | 2.20 | 1.50 | 1.75 |
| Perfume | 2.2 | 2.5 | 2.5 | 2.5 | 2 | 2.5 | 3 | 2 | 2 |
| DTPA[5] | 0.01 | 0.01 | 0.01 | 0.01 | 0.01 | 0.01 | 0.01 | 0.01 | 0.01 |
| Blue Dye | 0.0003 | 0.0003 | 0.0003 | 0.0003 | 0.0003 | 0.0003 | 0.0003 | 0.0003 | 0.0003 |
| Deionized Water | Bal. | Bal. | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]2-Ethyl-1,3-Hexanediol
[3]Ethoxylated alkyl alcohol, trademarked by Shell
[4]polyoxylethylene, polyoxypropylene block copolymer, trademarked by BASF
[5]diethylene triamine pentaacetate

TABLE 3

Weight Efficiency of Various Phase Stabilizers

| Component Wt % | 1 | 2 | 3 | 4 | 5 |
|---|---|---|---|---|---|
| TEA Di-ester Quat.[1] | 30 | 30 | 30 | 30 | 30 |
| Ethanol (from softener active) | 2.47 | 2.47 | 2.47 | 2.47 | 2.47 |
| Hexylene Glycol (from softener active) | 2.65 | 2.65 | 2.65 | 2.65 | 2.65 |
| TMPD | 6 | 6 | 6 | 6 | — |
| EHD | — | — | — | — | 6 |
| Hexylene Glycol | — | — | — | — | — |
| Phase Stabilizer | Neodol 91-8[2] | Tween ® 20[3] | Ethoquad ® C/25[4] | Ethomeen ® C/25[5] | Rewopal C6[6] |

TABLE 3-continued

| Weight Efficiency of Various Phase Stabilizers | | | | | |
|---|---|---|---|---|---|
| % Stabilizer | 5 | 8 | 5 | 5 | 7.8 |
| $MgCl_2$ | 2 | 1.75 | 1.75 | 1.5 | 1.75 |
| Perfume | 1.8 | 1.8 | 2.0 | 2.0 | 1.8 |
| DTPA[12] | 0.01 | — | — | — | — |
| Deionized $H_2O$ | Bal. | Bal. | Bal. | Bal. | Bal. |

| Component Wt % | 6 | 7 | 8 | 9 | 10 |
|---|---|---|---|---|---|
| TEA Di-ester Quat.[1] | 30 | 30 | 30 | 30 | 30 |
| Ethanol from softener active | 2.47 | 2.47 | 2.47 | 2.47 | 2.47 |
| Hexylene Glycol from softener active | 2.65 | 2.65 | 2.65 | 2.65 | 2.65 |
| TMPD | — | 2 | 3 | — | — |
| EHD | 6 | 4 | 3 | — | — |
| Hexylene glycol | — | | | 6 | 6 |
| Phase Stabilizer | Ethoduomeen ® T/25[7] | Variquat ® 66[8] | Tergitol ® 15S12[9] | Tergitol ® 15S12[9] | Tergitol ® 15S12[9] |
| % Phase Stabilizer | 4.2 | 4.47 | 4.7 | 4.6 | 5 |
| Electrolyte | $MgCl_2$ | $MgCl_2$ | $MgCl_2$ | $MgCl_2$ | $MgCl_2$ |
| % Electrolyte | 1.8 | 1.75 | 1.75 | 2.0 | 2.0 |
| Perfume | — | 1.8 | 1.8 | 2.5 | 2.5 |
| DTPA[12] | — | — | — | 0.01 | 0.01 |
| Deionized $H_2O$ | Bal. | Bal. | Bal. | Bal. | Bal. |

| Component Wt % | 11 | 12 | 13 | 14 |
|---|---|---|---|---|
| TEA Di-ester Quat.[1] | 30 | 30 | 30 | 30 |
| Ethanol from softener active | 2.47 | 2.47 | 2.47 | 2.47 |
| Hexylene Glycol from softener active | 2.65 | 2.65 | 2.65 | 2.65 |
| TMPD | 3 | 4 | 6 | 6 |
| EHD | 3 | 2 | — | — |
| Hexylene Glycol | — | — | — | — |
| Phase Stabilizer | Igepal ® CO-530[10] | Igepal ® CO-730[10] | Armeen ® APA 10[11] | Armeen ® APA 10 |
| % Phase Stabilizer | 7 | 4.3 | 3 | 3 |
| Electrolyte | $MgCl_2$ | $MgCl_2$ | $MgCl_2$ | Calcium Xylene Sulfonate |
| % Electrolyte | 1.75 | 1.75 | 1.5 | 2.25 |
| Perfume | 1.8 | 1.8 | 1.8 | 1.8 |
| DTPA[12] | | | | |
| Deionized $H_2O$ | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]Ethoxylated alkyl alcohol, trademarked by Shell
[3]Ethoxylated sorbitan ester, trademarked by ICI Americas
[4]Ethoxylated alkyl ammonium chloride, trademarked by Akzo Nobel
[5]Ethoxylated alkyl amine, trademarked by Akzo Nobel
[6]Ethoxylated alkyl amide, trademarked by Witco
[7]Ethoxylated alkyl aminopropyl amine, trademarked by Akzo Nobel
[8]Ethoxylated monoalkyl ammonium ethylsulfate, trademarked by Witco
[9]Ethoxylated alkyl alcohol, trademarked by Union Carbide
[10]Ethoxylated alkyl phenol, trademarked by GAF
[11]Alkyl amido propyl amine, trademarked by Akzo Nobel
[12]Diethylene triamine pentaacetate

TABLE 4

| 30% MDEA quat softener with different solvent systems | | | |
|---|---|---|---|
| Component Wt % | 1 | 2 | 3 |
| MDEA Diester Quat.[1] | 30 | 30 | 30 |
| Ethanol (from softener active) | 2.47 | 2.47 | 2.47 |
| Hexylene Glycol (from softener active) | 2.65 | 2.65 | 2.65 |
| TMPD | 12 | — | — |
| EHD | — | 12 | — |
| Hexylene Glycol | — | — | 20 |
| Neodol ® 91-8[2] | 5 | 6 | 3 |
| $MgCl_2$ | 3.56 | 4 | 1.75 |

TABLE 4-continued

| 30% MDEA quat softener with different solvent systems | | | |
|---|---|---|---|
| Component Wt % | 1 | 2 | 3 |
| Perfume | 1.8 | 1.8 | 1.8 |
| De-ionized Water | Bal. | Bal. | Bal. |

[1]Di(acyloxyethyl)dimethyl ammonium chloride where the acyl group is derived from partially hydrogenated canola fatty acid.
[2]Ethoxylated alkyl alcohol, trademarked by Shell

TABLE 5

Fabric Softener Compositions with Low Solvent Levels and Various Principal Solvents.

| Component Wt % | 1 | 2 | 3 | 4 | 5 | 6 |
|---|---|---|---|---|---|---|
| TEA Di-ester Quat.[1] | 30 | 30 | 45 | 40 | 45 | 30 |
| Ethanol (from softener active) | 2.47 | 2.47 | 3.71 | 3.29 | 3.71 | 2.47 |
| Hexylene Glycol (from softener active) | 2.65 | 2.65 | 3.97 | 3.53 | 3.97 | 2.65 |
| Principal Solvent | | | | | | |
| TMPD | 5 | 5 | — | — | — | 4 |
| 1,2-Hexanediol | — | — | 1 | — | — | — |
| 1,2-Pentanediol | — | — | — | 1 | — | — |
| 1,2-Butanediol | — | — | — | — | 3 | — |
| Phase Stabilizer | | | | | | |
| Neodol ® 91-8[2] | 5 | 5 | — | — | — | 5 |
| Rewopal ® C6[3] | — | — | 2.9 | 2.9 | 2.9 | — |
| Pluronic ® L35[4] | 1 | 1 | 0.5 | 1 | — | 1 |
| $MgCl_2$ | 1.75 | — | — | — | — | 1.75 |
| $CaC1_2$ | — | 1.75 | 1 | 1 | 1 | — |
| Perfume | 1.8 | 2.0 | 1.5 | 1.5 | 1.5 | 2.2 |
| De-ionized Water | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]Ethoxylated alkyl alcohol, trademarked by Shell
[3]Ethoxylated alkyl amide, trademarked by Witco
[4]polyoxylethylene - polyoxypropylene block copolymer, trademarked by BASF

TABLE 6

Fabric Softening Compositions with 45% Fabric Softener Active and Various Electrolytes and Solvent Systems.

| Component Wt % | 1 | 2 | 3 | 4 | 5 | 6 | 7 |
|---|---|---|---|---|---|---|---|
| TEA Di-ester Quat.[1] | 45 | 45 | 45 | 45 | 45 | 45 | 45 |
| Ethanol (from active) | 7 | 3.71 | 3.71 | 3.71 | 3.71 | 3.71 | 3.71 |
| Hexylene Glycol (from active) | — | 3.97 | 3.97 | 3.97 | 3.97 | 3.97 | 3.97 |
| Pinacol | — | 3 | — | — | — | — | — |
| Neopentyl Glycol | — | — | 3 | — | — | — | — |
| Methyl Lactate | — | — | — | 3 | — | — | — |
| 1,5-Hexanediol | — | — | — | — | 3 | — | — |
| Isopropanol | — | — | — | — | — | 3 | — |
| Butyl Carbitol | — | — | — | — | — | — | 3.1 |
| Rewopal ® C6[2] | 3 | 3 | 3 | 3 | 3 | 3 | 3.6 |
| Electrolyte | KCl | KCl | $CaCl_2$ | Methyl lactate | K Citrate | $CaCl_2$ | $CaCl_2$ |
| % of Electrolyte | 1 | 1 | 1 | 3 | 2 | 1 | 1.2 |
| Perfume | 1.5 | 1.5 | 1.5 | 1.5 | 1.5 | 1.5 | 2 |
| De-ionized Water | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]Ethoxylated alkyl amide, trademarked by Witco

TABLE 7

Fabric Softening Compositions with Hexylene Glycol as Principal Solvent and Rewopal ® C-6 as Phase Stabilizer.

| Component Wt % | 1 | 2 | 3 | 4 | 5 | 6 | 7 | 8 |
|---|---|---|---|---|---|---|---|---|
| TEA Di-ester Quat.[1] | 45 | 45 | 45 | 45 | 45 | 45 | 36 | 30 |
| Ethanol (from active) | 3.7 | 3.7 | 3.7 | 3.7 | 3.7 | — | 3.3 | 2.5 |
| Hexylene Glycol (from active) | 4 | 4 | 4 | 4 | 4 | 3.97 | — | 2.7 |

TABLE 7-continued

Fabric Softening Compositions with Hexylene Glycol as Principal Solvent and Rewopal ® C-6 as Phase Stabilizer.

| Component Wt % | 1 | 2 | 3 | 4 | 5 | 6 | 7 | 8 |
|---|---|---|---|---|---|---|---|---|
| Hexylene Glycol | 3 | 6 | 9 | 7.3 | 3 | 2.03 | 6.5 | 9.0 |
| Rewopal ® C6[2] | 3.5 | 2.5 | 1.5 | 3.1 | 2.9 | 3.0 | 1.8 | 3.0 |
| $CaCl_2$ | 1.1 | 1.1 | 0.8 | 2 | 1 | 1 | 1.2 | 0.95 |
| Perfume | 2.0 | 2.0 | 2.0 | 2.0 | 1.5 | 1.5 | 1.2 | 1.5 |
| De-ionized Water | Bal. | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid
[2]Ethoxylated alkyl amide, trademarked by Witco

TABLE 8

Fabric softener compositions with Hexylene Glycol as Principal Solvent and Neodol ® 91-8 as Phase Stabilizer

| Component Wt % | 1 | 2 | 3 | 4 | 5 | 6 | 7 |
|---|---|---|---|---|---|---|---|
| TEA Di-ester Quat. 1 | 28 | 32 | 32 | 30 | 30 | 30 | 30 |
| Ethanol (from active) | 2.3 | 2.6 | 2.6 | 2.5 | 2.5 | 2.5 | 2.5 |
| Hexylene Glycol (from active) | 2.5 | 2.8 | 2.8 | 2.7 | 2.7 | 2.7 | 2.7 |

TABLE 8-continued

Fabric softener compositions with Hexylene Glycol as Principal Solvent and Neodol ® 91-8 as Phase Stabilizer

| Component Wt % | 1 | 2 | 3 | 4 | 5 | 6 | 7 |
|---|---|---|---|---|---|---|---|
| Hexylene Glycol | 3 | 3.3 | 6.1 | 6 | 6 | 6 | 6.3 |
| Neodol ® 91-8[2] | 3.1 | 3.0 | 4.9 | 4 | 5 | 4.6 | 4.5 |
| $MgCl_2$ | — | — | — | 2 | 2 | 2 | 1.5 |
| $CaCl_2$ | 2.1 | 2 | 1 | — | — | — | — |

TABLE 8-continued

Fabric softener compositions with Hexylene Glycol as Principal Solvent and Neodol ® 91-8 as Phase Stabilizer

| Component Wt % | 1 | 2 | 3 | 4 | 5 | 6 | 7 |
|---|---|---|---|---|---|---|---|
| Perfume | 1.0 | 1.1 | 3.2 | 2.2 | 2.5 | 2.7 | 2.5 |
| De-ionized Water | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid
[2]Ethoxylated alkyl alcohol, trademarked by Shell

TABLE 9

Fabric Softening Compositions with Hexylene Glycol as Principal Solvent and Hydrotrope

| Component Wt % | 1 | 2 | 3 | 4 | 5 | 6 |
|---|---|---|---|---|---|---|
| TEA Di-ester Quat.[1] | 36 | 30 | 30 | 30 | 30 | 30 |
| Ethanol (from active) | 3.3 | 2.5 | 2.5 | 2.5 | 2.5 | 2.5 |
| Hexylene Glycol (from active) | — | 2.7 | 2.7 | 2.7 | 2.7 | 2.7 |
| Hexylene Glycol | 6.5 | 6 | 6 | 6 | 6 | 6 |
| Rewopal ® C6[2] | 1.8 | — | — | — | — | — |
| Neodol ® 91-8[3] | — | 5 | 5 | 5 | 5 | 5 |
| $MgCl_2$ | — | — | 1 | 1.7 | 1 | 1 |
| Sodium Cumene Sulfonate | 1 | — | — | — | — | — |
| Sodium Xylene Sulfonate | — | 2 | 1 | 1.25 | 0.5 | 1.25 |
| Perfume | 1.2 | 2.5 | 2.5 | 2.5 | 2.6 | 2.5 |
| De-ionized Water | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid
[2]Ethoxylated alkyl amide, trademarked by Witco
[3]Ethoxylated alkyl alcohol, trademarked by Shell

TABLE 10

Fabric Softener Composition with Blended Principal Solvent Systems

| Component Wt % | 1 | 2 | 3 | 4 | 5 | 6 | 7 |
|---|---|---|---|---|---|---|---|
| TEA Di-ester Quat.[1] | 30 | 30 | 30 | 30 | 30 | 30 | 30 |
| Ethanol (from active) | 2.5 | 2.5 | 2.5 | 2.5 | 2.5 | 2.5 | 2.5 |
| Hexylene Glycol (from active) | 2.7 | 2.7 | 2.7 | 2.7 | 2.7 | 2.7 | 2.7 |
| TMPD | — | — | — | 3 | — | — | 3 |
| Hexylene Glycol | 5.5 | 5 | 4.0 | 3 | 5.5 | 5 | 3 |
| EHD | 0.5 | 1.0 | 2.0 | — | — | — | — |
| Propylene carbonate | — | — | — | — | 0.5 | 1.0 | — |
| Neodol ® 91-8[2] | 4.0 | 4.0 | 4.0 | 5 | 4.0 | 4.0 | 5.0 |
| $MgCl_2$ | 2.0 | 2.0 | 2.0 | 2 | 2.0 | 2.0 | 2.0 |
| DTPA[3] | 0.01 | 0.01 | 0.01 | 0.01 | 0.01 | 0.01 | 0.01 |
| Perfume | 2.0 | 2.0 | 2.0 | 2.5 | 2.0 | 2.5 | 2.5 |
| Dye | 0.0008 | 0.0005 | 0.0008 | 0.0008 | 0.0008 | 0.0008 | 0.0008 |
| De-ionized Water | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid
[2]Ethoxylated alkyl alcohol, trademarked by Shell
[3]diethylene triamine pentaacetate

TABLE 11

Fabric Softening Compositions

| Component Wt % | 1 | 2 | 3 | 4 |
|---|---|---|---|---|
| TEA Di-ester Quat.[1] | 30 | 30 | 45 | 45 |
| Ethanol (from active) | 2.5 | 2.5 | 3.7 | 3.7 |

TABLE 11-continued

Fabric Softening Compositions

| Component Wt % | 1 | 2 | 3 | 4 |
|---|---|---|---|---|
| Hexylene Glycol (from active) | 2.7 | 2.7 | 4.0 | 4.0 |
| Hexylene Glycol | 6 | 6 | — | 10 |
| TMPD | — | — | 10 | — |
| Neodol ® 91-8[2] | 4.5 | 4.5 | — | — |
| Tergitol 15S9[3] | — | — | 2.6 | 2.6 |
| $CaCl_2$ | — | — | 0.75 | 0.75 |
| $MgCl_2$ | 1.5 | 1.5 | — | — |
| DTPA[4] | — | 0.2 | — | — |
| Ammonium chloride | 0.1 | 0.1 | — | — |
| TPED[5] | — | — | 0.2 | 0.2 |
| Perfume | 2.5 | 2.5 | 2.5 | 2.5 |
| De-ionized Water | Bal. | Bal. | Bal. | Bal. |

[1]Di(acyloxyethyl)(2-hydroxyethyl)methyl ammonium methyl sulfate where the acyl group is derived from partially hydrogenated canola fatty acid
[2]Ethoxylated alkyl alcohol, trademarked by Shell
[3]Ethoxylated alkyl alcohol, trademarked by Union Carbide
[4]Diethylene triamine pentaacetate
[5]tetrakis-(2-hydroxylpropyl)ethylenediamine

TABLE 12

Data Demonstrating Lower Fabric Softener Residue in the Dispenser for High Electrolyte Formula vs. Low Electrolyte Formula.

| Fabric Softener Composition and Dilution Weight ratio of High Electrolyte Composition to Water | Average Amt. Composition + Water Left in Dispenser (Average % of Total Composition + Water Left in Dispenser) |
|---|---|
| 1:1 High Electrolyte/Water | 2.32 g (3.9%) |
| 1:1 Low Electrolyte/Water | 23.08 g (38.5%) |
| 1:2 High Electrolyte/Water | 7.38 g (6.2%) |

TABLE 12-continued

Data Demonstrating Lower Fabric Softener Residue in the Dispenser for High Electrolyte Formula vs. Low Electrolyte Formula.

| Fabric Softener Composition and Dilution Weight ratio of High Electrolyte Composition to Water | Average Amt. Composition + Water Left in Dispenser (Average % of Total Composition + Water Left in Dispenser) |
|---|---|
| 1:2 Low Electrolyte/Water | 12.52 g (10.4%) |
| 1:5 High Electrolyte/Water | 1.1 g (0.7%) |
| 1:5 Low Electrolyte/Water | 3.07 g (1.7%) |

TABLE 13

Data Demonstrating Lower Fabric Staining Incidence for High Electrolyte Formula vs. Low Electrolyte Formula.

| Fabric Softener Composition and Dilution | Average Number of Fabric Stains per Cycle |
|---|---|
| 1:1 High Electrolyte/Water | 1.6 |
| 1:1 Low Electrolyte/Water | 0.6 |
| 1:2 High Electrolyte/Water | 1.2 |
| 1:2 Low Electrolyte/Water | 0.2 |
| 1:5 High Electrolyte/Water | 1.2 |
| 1:5 Low Electrolyte/Water | 0.4 |

surface). The overall effect of the clarity and the container being to demonstrate the clarity of the compositions, thus assuring the consumer of the quality of the product. The clarity and odor of the fabric softener are critical to acceptance, especially when higher levels of the fabric softener are present.

What is claimed is:

1. A clear or translucent, liquid fabric softener composition comprising:

(A) from about 2% to about 80% by weight of the composition of fabric softener;

(B) at least an effective level of principal solvent having a ClogP of from about −2.0 to about 2.6 to provide the clear or translucent composition;

(C) from 3.56 to about 10% by weight of the composition of electrolyte.

2. The composition of claim 1 wherein said fabric softener is present at a level of from about 13% to about 75% and has a phase transition temperature of less than about 35° C. and said principal solvent is present at a level of from about 1% to about 25% by weight of the composition and has a ClogP of from about −1 to about 1.6.

3. The composition of claim 2 wherein said fabric softener has a phase transition temperature of less than about 20° C.; and said principal solvent is present at a level of from about 3% to about 8% by weight of the composition and has a ClogP of from about −1 to about 1.

TABLE 14

Fabric Softener Compositions with Various Fabric Softener Levels and Solvent Systems

| Component (Wt %) | 1 | 2 | 3 | 4 | 5 | 6 | 7 | 8 | 9 |
|---|---|---|---|---|---|---|---|---|---|
| TEA Di-ester Quat.[1] | 30 | 35 | 30 | 30 | 30 | 35 | 30 | 35 | |
| TEA Di-ester Quat.[2] | | | | | | | | | 45 |
| Ethanol (from active) | 2.47 | 2.88 | 2.47 | 2.47 | 2.47 | 2.88 | 2.47 | 2.88 | |
| Hexylene Glycol (from active) | 2.7 | 3.1 | 2.7 | 2.7 | 2.7 | 3.1 | 2.7 | 3.1 | — |
| TMPD | 4 | 5 | — | 5 | 5 | — | — | — | — |
| Hexylene Glycol | — | — | 6 | — | — | 10 | — | 2 | — |
| EHD[3] | — | — | — | — | — | — | 6 | — | — |
| Isopropyl alcohol | — | — | — | — | — | — | — | — | 5 |
| 1-Heptanol | — | — | — | — | — | — | — | — | 1 |
| Neodol ® 91-8[4] | 5 | 6 | 4 | 6 | 6 | 5 | 5 | 5 | 5 |
| Pluronic ® L-35[5] | 1 | 1 | 1 | 1 | 1 | 1 | 1 | 1 | 1 |
| HCl | 0–0.25 | 0–0.25 | 0–0.25 | 0–0.25 | 0–0.25 | 0–0.25 | 0–0.25 | 0–0.25 | 0–0.25 |
| $MgCl_2$ | 1.75 | 1.75 | 2.00 | 1.75 | 1.75 | 2.20 | 1.50 | 1.75 | 4.1 |
| Perfume | 2.2 | 2.5 | 2.5 | 2 | 2.5 | 3 | 2 | 2 | 2 |
| DTPA[6] | 0.01 | 0.01 | 0.01 | 0.01 | 0.01 | 0.01 | 0.01 | 0.01 | 0.01 |
| Dye | 0.00025–0.00095 | 0.00025–0.00095 | 0.00025–0.00095 | 0.00025–0.00095 | 0.00025–0.00095 | 0.00025–0.00095 | 0.00025—0.00095 | 0.00025–0.00095 | 0.00021–0.00091 |
| Deionized Water | Bal. | Bal. | Bal. | Bal. | Bal. | Bal. | Bal. | Bal. | Bal. |

[1]Di(acyloxyethyl)(2-hydroxyethyl)methyl ammonium methyl sulfate where the acyl group is derived from partially hydrogenated canola fatty acid.
[2]Di(oleoyloxyethyl)(2-hydroxyethyl)methyl ammonium methyl sulfate.
[3]2-Ethyl-1,3-Hexanediol
[4]Ethoxylated alkyl alcohol, trademarked by Shell
[5]polyoxylethylene, polyoxypropylene block copolymer, trademarked by BASF
[6]diethylene triamine pentaacetate For commercial purposes, the above compositions are introduced into containers, specifically bottles, and more specifically clear bottles (although translucent bottles can be used), made from polypropylene (although glass, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the

4. The composition of claim 3 wherein said fabric softener has a phase transition temperature of less than about 10° C.

5. The composition of claim 1 wherein said fabric softener is biodegradable softener active selected from the group consisting of:

1. a compound having the formula:

$$[(R)_{4-m}—N^{(+)}—[(CH_2)_n—Y—R^1]_m]\ X^{(-)} \quad (1)$$

wherein each R substituent is hydrogen or short chain $C_1$–$C_6$ alkyl or hydroxyalkyl group, benzyl, or mixtures thereof; each m is 2 or 3; each n is from 1 to about 4; each Y is —O—(O)C—, —C(O)O—, —NR—C(O)—, or —C(O)NR—; each $R^1$ is a hydrocarbyl, or substituted hydrocarbyl, group, the sum of carbons in each $R^1$, plus one when Y is —O(O)C—, being $C_{12}$–$C_{22}$; the average Iodine Value of the parent fatty acid of the $R^1$ group being from about 40 to about 140; and wherein the counterion, $X^-$ is any softener-compatible anion:

2. a compound having the formula:

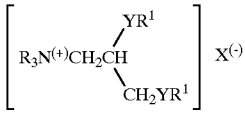

(2)

wherein each Y, R, $R^1$, and $X^{(-)}$ have the same meanings as before; and 3. mixtures thereof.

6. The composition of claim 1 wherein said fabric softener is selected from the group consisting of:

(1) a compound having the formula:

$$R_{4-m}—N^{(+)}—R^1{}_mA^-$$

wherein each m is 2 or 3, each $R^1$ is $C_6$–$C_{22}$, but no more than one being less than about $C_{12}$ and then the other is at least about 16, hydrocarbyl, or substituted hydrocarbyl substituent, where the Iodine Value is from about 70 to about 140 with a cis/trans ratio of from about 1:1 to about 50:1; each R is H or a short chain $C_1$–$C_6$ alkyl or hydroxyalkyl group, group, benzyl, or $(R^2O)_{0-4}H$ wherein $R^2$ is a $C_{1-6}$ alkylene group; and $A^-$ is a softener comparable anion:

(2) a compound having the formula:

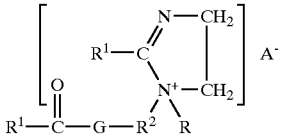

wherein each R, $R^1$, and $A^-$ have the definitions given above; each $R^2$ is a $C_{1-6}$ alkylene group; and G is an oxygen atom or an —NR— group;

(3) a compound having the formula:

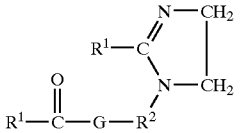

wherein $R^1$, $R^2$ and G are defined as above;

(4) reaction products of substantially unsaturated and/or branched chain higher fatty acids with dialkylenetriamines in, e.g., a molecular ratio of about 2:1;

(5) a compound having the formula:

$$[R^1—C(O)—R^2—N(R)_2—R^3—NR—C(O)—R^1]^+ A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

(7) a compound having the formula:

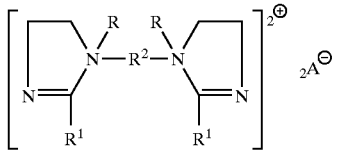

wherein R, $R^1$, $R^2$, and $A^-$ are defined as above; and (8) mixtures thereof.

7. The composition of claim 1 wherein said fabric softener is selected from the group consisting of:

1. a compound having the formula:

$$[(R)_{4-m}—N^{(+)}—[(CH_2)_n—Y—R^1]_m]\ X^{(-)} \quad (1)$$

wherein each R substituent is hydrogen or short chain $C_1$–$C_6$ alkyl or hydroxyalkyl group, benzyl, or mixtures thereof: each m is 2 or 3; each n is from 1 to about 4; each Y is —O—(O)C—, or —C(O)O—; each $R^1$ a hydrocarbyl, or substituted hydrocarbyl, group, the sum of carbons in each $R^1$, plus one when Y is —O—(O)C—, being $C_{12}$–$C_{22}$; the average Iodine Value of the parent fatty acid of the $R^1$ group being from about 40 to about 140; and wherein the counterion, $X^-$ is any softener-compatible anion;

2. a compound having the formula:

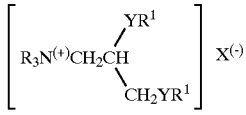

(2)

wherein each Y, R, $R^1$, and $X^{(-)}$ have the same meanings as before;

3. a compound having the formula:

$$R_{4-m}—N^{(+)}—R^1{}_mA^-$$

wherein each m is 2 or 3, each $R^1$ is a $C_6$–$C_{22}$, but no more than one being less than about $C_{12}$ and then the other is at least about 16, hydrocarbyl, or substituted hydrocarbyl substituent, where the Iodine Value is from about 70 to about 140 with a cis/trans ratio of from about 1:1 to about 50:1; each R is H or a short chain $C_1$–$C_6$ alkyl or hydroxyalkyl group, group, benzyl, or $(R^2O)_{0-4}H$ wherein $R^2$ is a $C_{1-6}$ alkylene group; and $A^-$ is a softener compatible anion;

4. a compound having the formula:

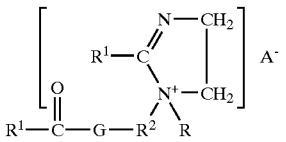

wherein each R, $R^1$, and $A^-$ have the definitions given above; each $R^2$ is a $C_{1-6}$ alkylene group; and G is an oxygen atom or an —NR— group;

5. a compound having the formula:

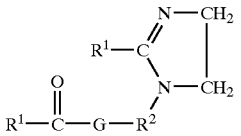

wherein $R^1$, $R^2$ and G are defined as above;

6. reaction products of substantially unsaturated and/or branched chain higher fatty acids with dialkylenetriamines in, e.g., a molecular ratio of about 2:1;

7. a compound having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

8. a reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

9. a compound having the formula:

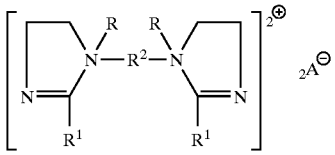

wherein R, $R^1$, $R^2$, and $A^-$ are defined as above; and 10. mixtures thereof.

8. The composition of claim 1 wherein said principal solvent has a ClogP of from about −2 to less than 0.15.

9. The composition of claim 8 wherein said principal solvent has a ClogP of from about −1.7 to less than 0.15.

10. The composition of claim 9 wherein said principal solvent has a ClogP of from about −1 to less than 0.15.

11. The composition of claim 1 wherein said principal solvent has a ClogP of from more than 0.64 to about 2.6.

12. The composition of claim 11 wherein said principal solvent has a ClogP of from more than 1 to about 2.6.

13. The composition of claim 11 wherein said principal solvent has a ClogP of from more than 0.64 to about 1.6.

14. The composition of claim 11 wherein said principal solvent has a ClogP of from more than 1 to about 1.6.

15. The composition of claim 1 wherein said electrolyte is selected from the group consisting of: $MgI_2$, $MgBr_2$, $MgCl_2$, $Mg(NO_2)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $NaSO_4$, $Na_2SO_3$, $NaNO_3$, $NaIO_3$, $Na(PO_4)_3$, $Na_4P_2O_3$, sodium silicate, sodium metasilicate, sodium tetrachloroaluminate, sodium tripolyphosphate, $Na_2Si_3O_4$, sodium zirconate, $CuF_2$, $CaCl_2$, $CaBr_2$, $CaI_2$, $CASO_4$, $Ca(NO_2)_2$, KI, KBr, KCl, KF, $KNO_3$, $KIO_3$, $K_2SO_4$, $K_2SO_3$, $K(PO_4)_3$, $K_4(P_2O_3)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_2)_3$, aluminum silicate, hydrates or these salts, salts with mixed sodium, potassium, magnesium and/or calcium cations, and mixtures thereof.

16. The composition of claim 1 further comprising a phase stabilizer comprising a nonionic surfactant derived from saturated and/or unsaturated primary, secondary, and/or branched, amine, amide, amine-oxide, fatty alcohol, fatty acid, alkyl phenol, and/or alkyl aryl carboxylic acid compound, each having from about 6 to about 22 carboxylic atoms in an alkyl or alkylene chain, wherein at least one active hydrogen of said compound is ethoxylated with 30 ethylene oxide moieties to provide an HLB of from about 8 to about 20.

17. The composition or claim 16 wherein said compound has from about 8 to about 18 carbon atoms in the alkyl or alkenyl chain and contains from about 5 to about 15 of said ethylene oxide moieties to provide an HLB of from about 10 to about 18.

18. The composition of claim 17 wherein said compound contains from about 8 to about 12 of said ethylene oxide moieties to provide an B of from about 11 to about 15.

19. The composition of claim 1 further comprising a phase stabilizer comprising a nonionic surfactant wherein said surfactant comprises a substantial head group selected from:

a. a surfactant having either one of the following formulas:

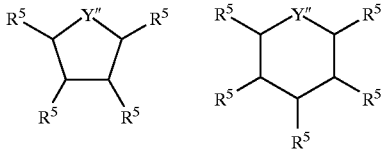

wherein Y"=N or O; and each R is selected independently from the following: —H, —OH, —$(CH_2)xCH_3$, —$O(OR^2)_z$—H, —$OR^1$, —$OC(O)R^1$, and —CH$(CH_2—(OR^2)_{z'}$, —H)—$CH_2$—$(OR^2)_{z''}$—$C(O)R^1$, x and $R^1$ are as defined above and z, z', and z" is from about 5 to about 20;

b. a polyhydroxy fatty acid amide surfactant of the formula:

$$R^2—C(O)—N(R^1)—Z$$

wherein each $R^1$ is H, $C_1$–$C_4$ hydrocarbyl, $C_1$–$C_4$ alkoxyalkyl, or hydroxyalkyl; $R^2$ is a $C_5$–$C_{2-1}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and c. mixtures thereof.

20. The composition or claim 1 further comprising a phase stabilizer that comprises a surfactant complex formed by one surfactant ion being neutralized with surfactant ion of opposite charge or an electrolyte ion that is suitable for reducing dilution viscosity.

21. The composition of claim 1 further comprising a phase stabilizer that comprises a block copolymer surfactant comprising a polyethylene oxide moiety and a propylene oxide moiety.

22. The composition of claim 1, further comprising a phase stabilizer that comprises a cationic surfactant having the formula:

$$\{R_m^1—Y—[(R^2—O)_4—H]_p\}^+X^-$$

wherein $R^1$ is selected from the group consisting of saturated or unsaturated, primary, secondary or branched chain alkyl or alkyl-aryl hydrocarbons; said hydrocarbon chain having from about 6 to about 22 carbon atoms; each $R^1$ is selected from the following groups or combinations of the following groups: $—(CH_2)_n—$ and/or $—[CH(CH_2)CH_3]—$; Y is selected from the following groups: $=N^+—(A)_q$; $—(CH_2)_u—N^+—(A)_q$; $—B—(CH_1)_u—N^+—(A)_2$; -(phenyl)-N+—$(A)_q$; -(B-phenyl)-$N^+$—$(A)_q$; with n being from about 1 to about 4, wherein each A is independently selected from the following groups: H; $C_{1-5}$ alkyl; $R^1$; $—(R^2O)_z—H$; $—(CH_2)_x CH_3$; phenyl, and substituted aryl; where $0 \leqq x \leqq$ about 3; and each B is selected from the following groups: —O—; —NA—; $—NA_2—$; —C(O)O—; and —C(O)N(A)—; m is 1 or 2, p is 1 or 2, q is 1 or 2, and m+p+q=4; total z per molecule is from about 3 to about 50; and $X^-$ is an anion which is compatible with fabric softener actives and adjunct ingredients.

23. The composition of claim 22 wherein $R^1$ is an alkyl group which contains from about 8 to about 22 carbon atoms; $R^2$ is $—(CH_z)_n—$ where n=2; total z=from about 3 to about 20; p=2; Y is $=N^+(A)_q$ wherein A is a $C_{1-4}$ alkyl group and q is one.

24. The composition of claim 23 wherein $R^1$ is an alkyl group which contains from about 12 to about 18 carbon atoms; total z=from about 5 to about 16; A is a $C_2$ alkyl group and X is ethyl sulfate.

25. The composition of claim 1 comprising: principal solvent having a ClogP of less than 0.15 or more than 0.64 to provide clarity or translucency in the composition, the level being selected so that the clarity and/or translucency is improved in the presence of said electrolyte.

26. The composition of claim 1 comprising an effective level up to about 10% by weight of the composition of electrolyte to provide the composition having a G' of $\leqq$20 Pa and a G" of $\leqq$6 Pa wherein G' and G" are measured on dilute solutions with maximum viscosity, the composition having higher G' and G" without said electrolyte being present.

27. The composition of claim 26 wherein G' and G" are measured over a strain range of 0.1–1.0.

28. The composition of claim 1 comprising the principal solvent at a level that would not provide a stable composition in the absence of said electrolyte and/or a phase stabilizer.

29. The composition of claim 1 further comprising a phase stabilizer, wherein said phase stabilizer is derived from a $C_8$–$C_{14}$, fatty alcohol ethoxylated with from about 5 to about 15 moles of ethylene oxide.

30. The composition of claim 1 wherein said composition comprises from about 4% to about 10%, by weight of said composition, of said electrolyte.

31. The composition of claim 1 wherein said principal solvent has a ClogP of from about −2.0 to less than 0.15 or from more than 0.64 to about 2.6.

32. The composition of claim 1 wherein said composition comprises no more than about 14.65% by weight of said composition, of said principal solvent.

* * * * *